US008439527B2

(12) United States Patent
Takahasi et al.

(10) Patent No.: US 8,439,527 B2
(45) **Date of Patent: *May 14, 2013**

(54) BULB-TYPE LAMP AND LIGHTING DEVICE

(75) Inventors: Kenzi Takahasi, Osaka (JP); Yasushige Tomiyoshi, Osaka (JP); Satoshi Shida, Osaka (JP); Tatsumi Setomoto, Osaka (JP); Akira Taniuchi, Osaka (JP); Takaari Uemoto, Osaka (JP); Hideo Nagai, Osaka (JP)

(73) Assignee: Panasonic Corporation, Osaka (JP)

( * ) Notice: Subject to any disclaimer, the term of this patent is extended or adjusted under 35 U.S.C. 154(b) by 25 days.

This patent is subject to a terminal disclaimer.

(21) Appl. No.: 13/243,517

(22) Filed: Sep. 23, 2011

(65) Prior Publication Data

US 2012/0044684 A1 Feb. 23, 2012

Related U.S. Application Data

(62) Division of application No. 12/994,743, filed as application No. PCT/JP2010/002864 on Apr. 21, 2010, now Pat. No. 8,047,688.

(30) Foreign Application Priority Data

Sep. 9, 2009 (JP) ..... 2009-208250
Dec. 1, 2009 (JP) ..... 2009-273524

(51) Int. Cl.
*F21V 7/00* (2006.01)

(52) U.S. Cl.
USPC ..... 362/310; 362/545; 362/548; 362/612; 313/318.08

(58) Field of Classification Search ..... 362/296.02, 362/310, 543–545, 548, 645–647, 650; 312/317, 312/318.01, 318.06, 318.08
See application file for complete search history.

(56) References Cited

U.S. PATENT DOCUMENTS 6,799,864 B2 10/2004 Bohler et al.
7,111,961 B2 9/2006 Trenchard et al.
7,758,223 B2 7/2010 Osawa et al.

(Continued)

FOREIGN PATENT DOCUMENTS

JP 199-005009 1/1994
JP 2001-243809 9/2001

(Continued)

OTHER PUBLICATIONS

European Application No. 10779448.9 Extended European Search Report dated Jul. 24, 2012, 10 pages.

*Primary Examiner* — John A Ward

(57) ABSTRACT

Provided is a bulb-type lamp including a lightweight housing with great handleability. An LED light bulb comprises: an LED module on which LEDs are mounted; a cylindrically-shaped case having openings at both ends, which are first and second ends; a mount member on a front surface of which the LED module is mounted, the mount member closing a corresponding one of the openings of the case by being in contact with an inner circumferential surface of the first end of the case; a base member attached to the second end of the case; and a lighting circuit that is disposed inside the case. A wall thickness of the case is in a range of 200 μm to 500 μm inclusive, and the wall thickness of at least one portion of the case decreases from the first end toward the second end of the case.

8 Claims, 16 Drawing Sheets

U.S. PATENT DOCUMENTS

| | | | | |
|---|---|---|---|---|
| 7,762,700 | B2 | 7/2010 | Luo et al. | |
| 8,038,329 | B2 * | 10/2011 | Takahasi et al. | 362/373 |
| 8,047,688 | B2 * | 11/2011 | Takahasi et al. | 362/310 |
| 8,322,898 | B2 * | 12/2012 | Takahasi et al. | 362/373 |
| 2002/0117692 | A1 | 8/2002 | Lin | |
| 2006/0227558 | A1 * | 10/2006 | Osawa et al. | 362/351 |
| 2010/0096992 | A1 | 4/2010 | Yamamoto et al. | |
| 2010/0219735 | A1 | 9/2010 | Sakai et al. | |
| 2010/0237761 | A1 * | 9/2010 | Osawa et al. | 313/46 |
| 2010/0237779 | A1 * | 9/2010 | Osawa et al. | 315/32 |
| 2010/0244650 | A1 | 9/2010 | Osawa et al. | |
| 2010/0244694 | A1 | 9/2010 | Osawa et al. | |
| 2010/0253200 | A1 | 10/2010 | Osawa et al. | |
| 2011/0068687 | A1 | 3/2011 | Takahasi et al. | |

FOREIGN PATENT DOCUMENTS

| | | |
|---|---|---|
| JP | 2003-151307 | 5/2003 |
| JP | 2006-156187 | 6/2006 |
| JP | 2006-202612 | 8/2006 |
| JP | 2006-313718 | 11/2006 |
| JP | 2006-313727 | 11/2006 |
| JP | 2007-188832 | 7/2007 |
| JP | 2007-317431 | 12/2007 |
| JP | 2009-004130 | 1/2009 |
| JP | 2009-037995 | 2/2009 |
| JP | 2 077 415 | 8/2009 |

* cited by examiner

Unit: mm

| | A | B | C | D | E |
|---|---|---|---|---|---|
| 40-watt equivalent | 39.5 | 38.7 | 4.5 | 32 | 23 |
| 60-watt equivalent | 54.5 | 51.9 | 7 | 43.4 | 33.4 |

Unit: mm

| x | 5mm | 10mm | 15mm | 20mm | 25mm | 30mm | Bottom Wall |
|---|---|---|---|---|---|---|---|
| Sample 1 | 0.335 | 0.329 | 0.320 | 0.320 | 0.314 | 0.343 | 0.330 |
| Sample 2 | 0.340 | 0.331 | 0.321 | 0.310 | 0.320 | 0.348 | 0.328 |

FIG. 6A

In the case of 40-watt equivalent

| | Unanodized | White anodized | Black anodized |
|---|---|---|---|
| Emissivity | 0.05 | 0.8 | 0.95 |
| Tj(℃) | 116 | 98.5 | 95 |

FIG. 6B

In the case of 60-watt equivalent

| | Unanodized | White anodized | Black anodized |
|---|---|---|---|
| Emissivity | 0.05 | 0.8 | 0.95 |
| Tj(℃) | 101 | 82 | 78 |

Unit: mm

| | φD1 | L1 | L2 | φD2 | φD3 |
|---|---|---|---|---|---|
| 40-watt equivalent | 39.5 | 38.7 | 4.5 | 32 | 23 |
| 60-watt equivalent | 54.5 | 51.9 | 7 | 43.4 | 33.4 |

40-watt equivalent

Unit: mm

| y | 5mm | 10mm | 15mm | 20mm | 25mm | 30mm | Bent portion |
|---|---|---|---|---|---|---|---|
| Sample 1 | 0.335 | 0.329 | 0.320 | 0.320 | 0.314 | 0.343 | 0.330 |
| Sample 2 | 0.340 | 0.331 | 0.321 | 0.310 | 0.320 | 0.348 | 0.328 |

BULB-TYPE LAMP AND LIGHTING DEVICE

RELATED APPLICATIONS

This is a divisional application from U.S. application Ser. No. 12/994,743 filed on Nov. 24, 2010, which is a §371 application of PCT/JP2010/002864 filed on Apr. 21, 2010, which claims priority from Japanese Application No. 2009-273524 filed on Dec. 1, 2009 and Japanese Application No. 2009-208250 filed on Sep. 9, 2009.

TECHNICAL FIELD

The present invention relates to a bulb-type lamp that uses light emitting elements and can replace another light bulb, and to a lighting device.

BACKGROUND ART

In recent years, for the purpose of energy conservation and prevention of further global warming, research and development of lighting devices employing light emitting diodes (LEDs) have been conducted in the field of lighting. LEDs can achieve higher energy efficiency than conventional incandescent light bulbs and the like.

For example, a conventional incandescent light bulb offers an energy efficiency of tens of (1 m/W). In contrast, LEDs, when used as a light source, achieve higher energy efficiency—more specifically, an energy efficiency of 100 (1 m/W) or higher (hereinafter, a bulb-type lamp equipped with the LEDs and designed to replace another light bulb is referred to as an "LED light bulb").

Patent Literatures 1 and 2, etc. introduce an LED light bulb that can replace a conventional incandescent light bulb. The LED light bulb disclosed in Patent Literature 1 is structured as follows. A substrate, on which a plurality of LEDs have been mounted, is mounted on an edge surface of a housing, inside which a lighting circuit for lighting the LEDs (causing the LEDs to emit light) is disposed. The LEDs are covered by a dome-shaped globe.

This LED light bulb has a similar external shape to a conventional incandescent light bulb and comprises an Edison screw as a power supply terminal. Therefore, this LED light bulb can be attached to a lighting fixture to which a conventional incandescent light bulb is customarily attached.

[Citation List]

[Patent Literature]

[Patent Literature 1]

Japanese Patent Application Publication No. 2006-313718

[Patent Literature 2]

Japanese Patent Application Publication No. 2009-4130

SUMMARY OF INVENTION

Technical Problems

However, the housing of the above LED light bulb is made of metal and therefore has a large volume. Accordingly, the above LED light bulb is heavier than an incandescent light bulb. This gives rise to following safety problem: if the above LED light bulb is attached to a lighting fixture designed for an incandescent light bulb, then there will be an increase in the load applied to the lighting fixture for holding the LED light bulb.

Put another way, in terms of strength, a lighting fixture for an incandescent light bulb is designed on the basis of the weight of the incandescent light bulb. If an LED light bulb, which is heavier than an incandescent light bulb, is attached to such an existing lighting fixture, then a larger-than-expected stress may act on the components of the lighting fixture. This may result in damage (such as breakage) of the lighting fixture.

The aforementioned safety problem may be solved by, for example, making the housing with a thin wall thickness. This also achieves reduction in the weight of the LED light bulb. However, making the wall thickness of the housing too thin gives rise to the new problem that the housing becomes susceptible to deformation. Consequently, the housing may be deformed when attaching the LED light bulb to the lighting fixture, and handleability of the housing may be reduced during assembly and shipping thereof.

The present invention has been made to solve the above problems. It is an object of the present invention to provide a bulb-type lamp and a lighting device that allow reducing the weight of a housing, preventing deformation of the housing when attaching the housing to a lighting fixture, and improving handleability of the housing during assembly.

Solution to Problems

A bulb-type lamp of the present invention comprises: a light emitting module on which at least one light emitting element is mounted; a cylindrically-shaped housing having openings at both ends, which are first and second ends; a mount member on a front surface of which the light emitting module is mounted, the mount member closing a corresponding one of the openings of the housing by being in contact with an inner circumferential surface of the first end of the housing; a base attached to the second end of the housing; and a circuit that is disposed inside the housing and, upon receiving power via the base, causes the at least one light emitting element to emit light, wherein a wall thickness of the housing is in a range of 200 μm to 500 μm inclusive, and the wall thickness of at least one portion of the housing decreases from the first end toward the second end of the housing.

SUMMARY OF INVENTION

According to the above structure, the wall thickness of the housing is in a range of 200 (μm) to 500 (μm) inclusive. This can not only reduce the weight of the housing, but also prevent deformation of the housing. Especially, as long as one end of the hosing at an opening of the housing has a sufficient wall thickness to avoid deformation, a central portion of the housing in the central axis direction of the housing has sufficient stiffness. Hence, the central portion of the housing having sufficient stiffness can be made with a thinner wall thickness than the one end of the housing. This way, further weight reduction can be achieved while preserving the stiffness of the case.

In the bulb-type lamp, the housing includes a bent portion, and a portion of the housing that lies between the bent portion and the second end of the housing extends toward a central axis of the housing. Or, in the bulb-type lamp, the at least one portion of the housing is located between the first end and the bent portion of the housing.

In the bulb-type lamp, an outer circumferential surface of the mount member and the inner circumferential surface of the first end of the housing are sloped at the same angle of slope with respect to a central axis of the housing. Or, in the bulb-type lamp, a part of the at least one portion of the housing in proximity to the first end of the housing has a wall thickness in a range of 300 μm to 500 μm inclusive, and a part of the at least one portion of the housing in proximity to the second end of the housing has a wall thickness in a range of 250 μm to 350 μm, inclusive. Furthermore, in the bulb-type lamp, an outer circumferential surface of the housing is anodized.

A lighting device of the present invention comprises: a bulb-type lamp; and a lighting fixture to/from which the bulb-type lamp is attachable/detachable, wherein the bulb-type lamp is the above-described bulb-type lamp.

BRIEF DESCRIPTION OF DRAWINGS

FIGS. 6A and 6B show the heat dissipation properties of the case.

FIG. 8A illustrates one example of the mount members used in the test, and FIG. 8B shows measurement results obtained from the test.

FIG. 12A shows the shape of a case pertaining to modification example 1, and FIG. 12B shows the shape of a case pertaining to modification example 2.

DESCRIPTION OF EMBODIMENTS

With reference to the drawings, the following describes bulb-type lamps and lighting devices pertaining to exemplary embodiments of the present invention.

[First Embodiment]

1. Structure

Figure 1:
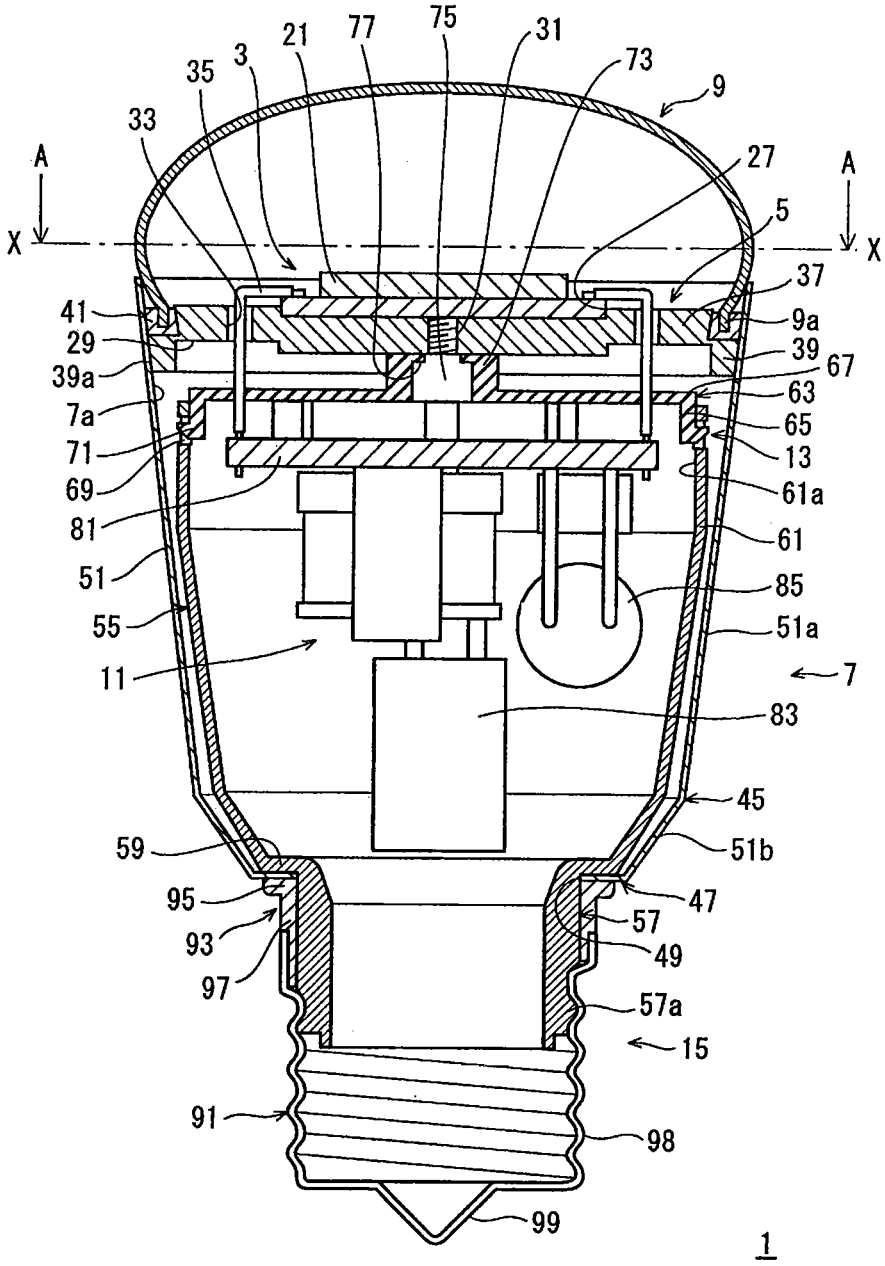
FIG. 1 is a longitudinal cross-sectional view of a bulb-type lamp pertaining to First Embodiment.
Figure 2:
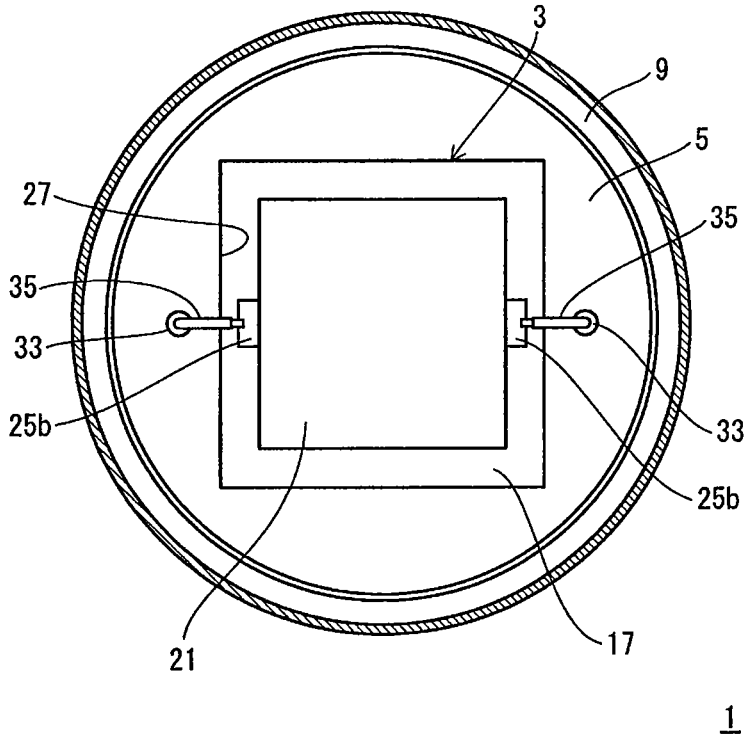
FIG. 2 shows a cross section taken along a line X-X of FIG. 1 when viewed in a direction of arrows A.

FIG. 1 is a longitudinal cross-sectional view of a bulb-type lamp pertaining to First Embodiment. FIG. 2 shows a cross section taken along a line X-X of FIG. 1 when viewed in a direction of arrows A.

As shown in FIG. 1, a bulb-type lamp (hereinafter referred to as an "LED light bulb") 1 is composed of (i) an LED module 3 comprising a plurality of LEDs as a light source, (ii) a mount member 5 on which the LED module 3 is mounted, (iii) a case 7, to a first end portion thereof the mount member 5 is attached, (iv) a globe 9 that covers the LED module 3, (v) a lighting circuit 11 that lights the LEDs (causes the LEDs to emit light), (vi) a circuit holder 13 positioned inside the case 7, with the lighting circuit 11 disposed inside the circuit holder 13, and (vii) a base member 15 attached to a second end portion of the case 7. The LEDs, the LED module 3, the case 7, and the lighting circuit 11 correspond to the "at least one light emitting element", "light emitting module", "housing", and "circuit" of the present invention, respectively.

(1) LED Module 3

Figure 3:
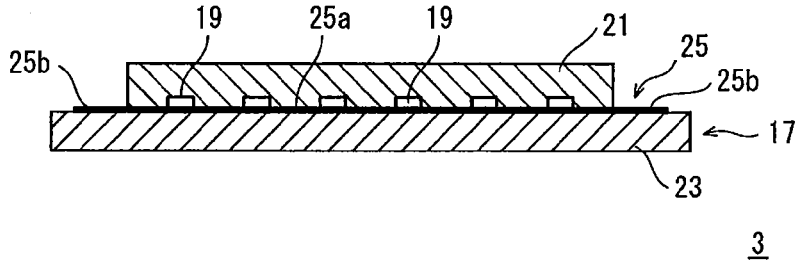
FIG. 3 is a cross-sectional view of an LED module.

FIG. 3 is a cross-sectional view of the LED module.

The LED module 3 is composed of a substrate 17, a plurality of LEDs 19 mounted on a main surface of the substrate 17, and a sealing member 21 for covering the LEDs 19. Note that the number of the LEDs 19, the method for connecting the LEDs 19 with one another (series connection or parallel connection), etc. are determined depending on, for example, desired luminous flux of the LED light bulb 1. The main surface of the substrate 17, on which the LEDs 19 have been mounted, is also referred to as an "LED-mounted surface".

The substrate 17 is composed of a substrate body 23 and a wiring pattern 25 formed on the substrate body 23. The substrate body 23 is made of, for example, an insulation material. The wiring pattern 25 is formed on a main surface of the substrate body 23.

The wiring pattern 25 includes (i) a connecting portion 25*a* that connects between the LEDs 19 using a predetermined connection method (e.g., series connection and parallel connection), and (ii) terminal portions 25*b* that connect to power supply paths (lead wires) connected to the lighting circuit 11.

The LEDs 19 are semiconductor light emitting elements that each emit light of a certain color. The sealing member 21 seals the LEDs 19 so that the LEDs 19 are not exposed to the open air. The sealing member 21 also has the function of converting the wavelength of part or an entirety of the light emitted by the LEDs 19 to a predetermined wavelength.

The sealing member 21 is made of, for example, a translucent material and a conversion material that converts the wavelength of the light emitted by the LEDs 19 to a predetermined wavelength.

(2) Mount Member 5

The LED module 3 is mounted on the mount member 5. The mount member 5 is in contact with an inner circumferential surface of the first end portion of the case 7, which has a cylindrical shape as described later, and closes an opening of the first end portion of the case 7 (herein, the terms "cylinder" and "cylindrical" refer to any tubular or columnar shape, and are not limited to referring to a circular cylindrical shape). In other words, the mount member 5 has a plate-like shape as shown in FIGS. 1 and 2. In planar view (i.e., when viewed along a direction in which a central axis of the LED light bulb 1 extends), the outer circumferential shape of the mount member 5 substantially fits the inner circumference shape of the first end portion of the case 7 at the opening. The mount member 5 closes the opening of the first end portion of the case 7 by being fit inside the first end portion of the case 7.

The LED module 3 is mounted on a surface of the mount member 5 that is facing the outside of the case 7 (the upper side in FIG. 1). This surface is regarded as a front surface of the mount member 5. In the present embodiment, the mount member 5 has a shape of a disk because the case 7 has a cylindrical shape, i.e., an annular shape in a transverse cross section (that is, the case 7 has a shape of a circular cylinder).

The front surface of the mount member 5 has a recess 27, in which the LED module is mounted. A back surface of the mount member 5 has a recess 29 for the purpose of weight reduction. The central area of the mount member 5 includes an internal thread portion 31. A connector member 75, which is a screw with an external thread for connecting the circuit holder 13 to the mount member 5 (described later), is screwed and fit into the internal thread portion 31.

The internal thread portion 31 may or may not penetrate through the mount member 5. When the internal thread portion 31 does not penetrate through the mount member 5, it is provided in a substantially central area of the back surface of the mount member 5.

The shape of the recess 27 in planar view is substantially identical to the shape of the LED module 3 in planar view. The LED module 3 is mounted in the recess 27 with a bottom surface of the recess 27 in surface contact with the substrate 17 of the LED module 3. Here, the LED module 3 may be mounted on the mount member 5 by, for example, directly securing the LED module 3 to the mount member 5 with the use of fixing screws, attaching the LED module 3 to the mount member 5 with the aid of a leaf spring and the like, or using an adhesive material. Presence of the recess 27 enables easy and accurate positioning of the LED module 3.

The mount member 5 has through holes 33 that penetrate through the mount member 5 in a thickness direction thereof. Power supply paths 35 from the lighting circuit 11 pass through the through holes 33 and are electrically connected to the terminal portions 25*b* of the substrate 17, respectively. Note that there should be at least one through hole 33. In a case where there is only one through hole 33, the two power supply paths (35) pass through one through hole (33). On the other hand, in a case where there are two through holes 33, each of the two power supply paths 35 passes through a different one of the through holes 33.

The mount member 5 includes an annular portion formed along the entire outer circumference thereof. The annular portion is closer to the base member 15 than the remaining portion of the mount member 5 is, and has a greater outer diameter than the remaining portion of the mount member 5. More specifically, the annular portion and the remaining portion of the mount member 5 represent a large diameter portion 39 and a small diameter portion 37, respectively. The large diameter portion 39 has a greater outer diameter than the small diameter portion 37. An outer circumferential surface 39*a* of the large diameter portion 39 is in contact with an inner circumferential surface 7*a* of the case 7.

A tip 9*a* of the globe 9 at an opening of the globe 9 is inserted in a space between the inner circumferential surface 7*a* of the case 7 and the small diameter portion 37. Once the tip 9*a* of the globe 9 has been thus inserted, it is secured with the use of an adhesive material 41 and the like.

The outer circumferential surface 39*a* of the large diameter portion 39 is sloped so that its outer diameter gradually decreases from one end of the large diameter portion 39 closer to the small diameter portion 37 (an upper end in FIG. 1) toward the other end of the large diameter portion 39 farther from the small diameter portion 37 (a lower end in FIG. 1). The angle of slope of the outer circumferential surface 39*a* is the same as the angle of slope of the inner circumferential surface 7*a* of the case 7 (described later).

(3) Case 7

As shown in FIG. 1, the case 7 has a shape of a cylinder having openings at both ends. The mount member 5 is attached to the first end portion of the case 7, and the base member 15 is attached to the second end portion of the case 7. The circuit holder 13 is positioned in a space within the case 7. The lighting circuit 11 is held (disposed) inside the circuit holder 13.

In the present embodiment, the case 7 is made up of a cylindrical wall 45 and a bottom wall 47 that is contiguous with one end of the cylindrical wall 45. A central portion of the bottom wall 47 (including a central axis of the cylindrical portion of the case 7) has an opening (a through hole) 49. Of the two openings of the cylindrically-shaped case 7, the opening having a large diameter is referred to as a "large opening", and the opening having a small diameter is referred to as a small opening 49.

The cylindrical wall 45 includes sloped cylindrical portions 51*a* and 51*b*. The outer and inner diameters of the sloped cylindrical portions 51*a* and 51*b* decrease along the central axis of the case 7, from one end of the cylindrical wall 45 at the large opening toward the other end of the cylindrical wall 45 contiguous with the bottom wall 47. Hereinafter, when it is not necessary to distinguish between the sloped cylindrical portions 51*a* and 51*b*, a reference number "51" will be simply assigned thereto instead of "51*a*" and "51*b*".

In the present First Embodiment, the sloped cylindrical portion 51*a* (closer to the large opening) has a smaller angle of slope than the sloped cylindrical portion 51*b* (closer to the bottom wall 47) with respect to the central axis of the case 7.

The heat generated while the LEDs 19 are being lit is conducted from the substrate 17 of the LED module 3 to the mount member 5, and from the mount member 5 to the case 7. After the heat has been conducted to the case 7, the heat is primarily dissipated to the open air. As such, the case 7 functions as a heat sink because it has a heat dissipation function, which allows dissipation of the heat generated while the LEDs 19 are being lit to the open air. The mount member 5 functions as a heat conduction member because it has a heat conduction function, which allows conduction of the heat from the LED module 3 to the case 7. As described later, the outer circumferential surface of the case 7 is anodized in order to improve heat dissipation properties.

The mount member 5 is attached to the case 7 by, for example, pressing the mount member 5 into the first end portion of the case 7 through the large opening. The position of the mount member 5 is determined due to the angle of slope of the inner circumferential surface 7*a* of the case 7 matching the angle of slope of the outer circumferential surface 39*a* of the mount member 5.

In order to prevent the mount member 5 from falling off the case 7, a protrusion that protrudes inward (toward the central axis of the case 7) is formed either (i) on a portion of the case 7 that is in contact with the mount member 5, or (ii) on a portion of the case 7 that is closer to the large opening than an end of the mount member 5 at the large opening is (i.e., a portion of the case 7 that is positioned above and in proximity to the upper edge of the mount member 5). This protrusion is formed by, for example, denting one of the above portions (i) and (ii) from the outer circumferential surface of the case 7 with use of the punch.

(4) Circuit Holder 13

The circuit holder 13 is made up of a holder body 55 that is positioned inside the case 7 and a protruding cylindrical portion 57 that has a cylindrical shape. The protruding cylindrical portion 57, which is contiguous with the holder body 55, penetrates through the small opening 49 of the case 7 and protrudes toward the outside of the case 7.

The holder body 55 is too large to penetrate through the small opening 49 of the case 7. The holder body 55 includes a contact portion 59 that comes in contact with the inner surface of the bottom wall 47 of the case 7 once the protruding cylindrical portion 57 has penetrated through the small opening 49 of the case 7 and protruded toward the outside of the case 7.

The circuit holder 13 is made up of a cylindrical body 61 and a cap 63. A part of the cylindrical body 61 penetrates through the small opening 49 of the case 7 and protrudes toward the outside of the case 7. The remaining part of the cylindrical body 61 is positioned inside the case 7. The cap 63 covers an opening 61*a* of said remaining part of the cylindrical body 61 that is positioned inside the case 7.

In other words, of the circuit holder 13 that is made up of the cylindrical body 61 and the cap 63, the holder body 55 is a part of the circuit holder 13 that is positioned inside the case 7. The protruding cylindrical portion 57 is a part of the cylindrical body 61 that penetrates through the small opening 49 of the case 7 and protrudes toward the outside of the case 7. The base member 15 is attached to the outer circumferential surface of the protruding cylindrical portion 57. Thus, a part or an entirety of the outer circumferential surface of the protruding cylindrical portion 57 has an external thread 57*a* (herein, the term "thread" refers to a screw thread wrapped around a screw).

The cap 63 has a shape of a cylinder with a bottom, and includes a cylindrical portion 65 and a cap portion 67. The cylindrical portion 65 of the cap 63 is to be inserted into an end portion of the cylindrical body 61 having a large diameter (it goes without saying that the cylindrical body may instead be inserted into the cap).

Figure 4:
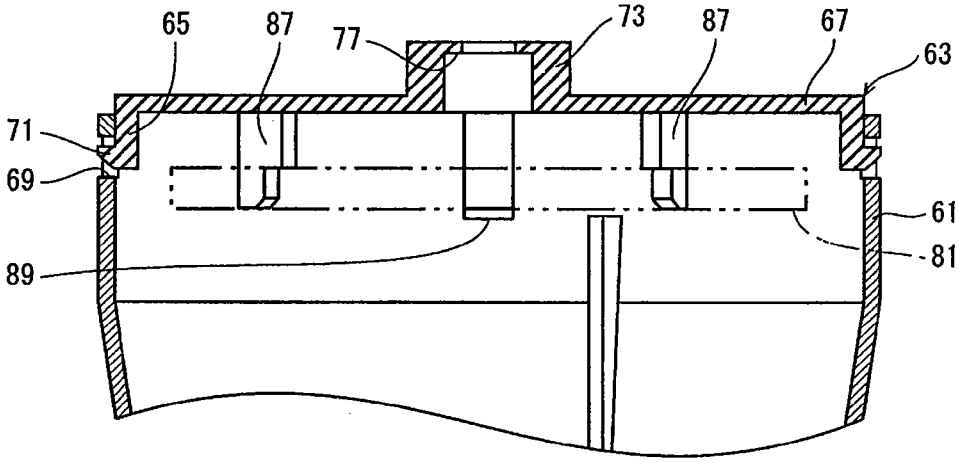
FIG. 4 is a cross-sectional view illustrating how a substrate of a circuit holder is attached.

As shown in FIG. 4, the cylindrical portion 65 of the cap 63 has a plurality of (in the present example, two) latching pawls 71 that latch with a plurality of (in the present example, two) latching holes 69 formed in the end portion of the cylindrical body 61 having a large diameter. In the course of inserting the cylindrical portion 65 into the cylindrical body 61, the latching pawls 71 latch with the latching holes 69. This way, the cap 63 is attached to the cylindrical body 61 in a detachable manner. Note that the latching pawls and the latching holes serve their purposes as long as they can latch with each other, and may be provided in a reverse manner—i.e., the latching holes and the latching pawls may be formed in the cylindrical portion of the cap and the cylindrical body, respectively.

Each latching hole 69 in the cylindrical body 61 is larger in size than each latching pawl 71 in the cap 63. To be more specific, as shown in FIG. 4, each latching hole 69 in the cylindrical body 61 is long in a direction along which the cylindrical portion 65 of the cap 63 is inserted into the cylindrical body 61 (i.e., a central axis direction of the cylindrical body 61) (that is, the latching holes 69 are elongated holes). Each latching hole 69 has a shape of, for example, a rectangle. This way, the cap 63 is attached to the cylindrical body 61 in such a manner that the cap 63 is movable in the direction along which it is inserted into the cylindrical body 61.

The cap 63 also includes a protruding portion 73 at its center. The protruding portion 73 protrudes toward the mount member 5 and has a shape of a cylinder with a bottom. A bottom 77 of the protruding portion 73 has a through hole. A tip of the bottom 77 of the protruding portion 73 is flat and comes in contact with the back surface of the mount member 5 once the cap 63 has been connected to the mount member 5.

A screw with an external thread—or more specifically, the connector member 75 for connecting between the circuit holder 13 and the mount member 5—is inserted into the protruding portion 73. At this time, the head of this screw comes into contact with the bottom 77 of the protruding portion 73. This restricts the head of the connector member 75 from entering a space inside the protruding portion 73.

The details of how the circuit holder 13 is attached to the case 7 will be described later. Briefly speaking, the circuit holder 13 is attached to the case 7 by causing the contact portion 59 of the circuit holder 13 and the base member 15 to hold the bottom wall 47 of the case 7 therebetween.

Clearance is provided (i) between (a) (outer surfaces of) portions of the circuit holder 13 other than the contact portion 59 and the protruding cylindrical portion 57 and (b) the inner circumferential surface 7*a* of the case 7, and (ii) between (a) (outer surfaces of) portions of the circuit holder 13 other than the protruding portion 73 of the cap 63 and (b) the back surface of the mount member 5. An air space exists in such clearance.

With this structure, the air space exists between the case 7 and the circuit holder 13. Accordingly, even if the temperature of the case 7 increases as a result of lighting the LED light bulb 1, an increase in the temperature of the circuit holder 13 is suppressed. This can prevent excessive increase in the temperature of the lighting circuit 11 disposed inside the circuit holder 13.

If a large load (for example, a compressive load that would dent the case 7) acts on the case 7, then the case 7, whose wall thickness is in a range of 200 (μm) to 500 (μm) inclusive, may be deformed or damaged. However, as the lighting circuit 11 is disposed inside the circuit holder 13 that is partially distanced from the case 7 with the air space (clearance) therebetween, the lighting circuit 11 can be protected from damage even if the case 7 is damaged.

(5) Lighting Circuit 11

The lighting circuit 11 lights the LEDs 19 by using commercial electric power supplied via the base member 15. The lighting circuit 11 is composed of a plurality of electronic components 83 and 85, etc. mounted on a substrate 81. For example, the lighting circuit 11 is composed of a rectifying/smoothing circuit, a DC/DC converter, and the like. Note that the plurality of electronic components are assigned the reference numbers "83" and "85" for convenience.

The electronic components 83 and 85 are mounted on one of main surfaces of the substrate 81. The substrate 81 is held inside the circuit holder 13 with the electronic components 83 and 85 opposing the protruding cylindrical portion 57 of the circuit holder 13. The power supply paths 35 connected to the LED module 3 are attached to the other one of the main surfaces of the substrate 81.

FIG. 4 is a cross-sectional view illustrating how the substrate of the circuit holder is attached.

In FIG. 4, only the substrate 81 is illustrated using a virtual line for convenience in order to explain how the substrate 81 is attached.

The electronic components 83 and 85, etc. that constitute the lighting circuit 11 have been mounted on the substrate 81. The substrate 81 is held by a clamp mechanism composed of a plurality of adjustment arms 87 and latching pawls 89 formed on the cap 63.

In the present embodiment, there are four adjustment arms 87 and four latching pawls 89. The adjustment arms 87 and the latching pawls 89 are alternately formed at equally spaced intervals along the circumferential direction of the cap 63, so that they protrude from the cap portion 67 toward the base member 15.

A tip of each adjustment arm 68 has a shape of a hook, and comes in contact with the surface of the substrate 81 facing the cap portion 67 and with a circumferential surface of the substrate 81. Each latching pawl 89 comes in contact (latches) with one of the main surfaces of the substrate 81 opposing the base member 15. This way, the substrate 81 is secured and held in a predetermined position within the circuit holder 13.

Note that the substrate 81 is held independently from the cylindrical body 61 and the cap 63 of the circuit holder 13—i.e., the substrate 81 is held in such a manner that it is not in direct contact with the cylindrical body 61 and the cap 63. For, example, even though the circuit holder 13 and the mount member 5 are in contact with each other by the connector member 75 connecting them together, the heat generated while the LEDs 19 are being lit can be suppressed from being conducted to the substrate 81.

(6) Globe 9

The globe 9 has a shape of, for example, a dome, and covers the LED module 3. In the present embodiment, the tip 9*a* of the globe 9 at the opening of the globe 9 is inserted in the space between the inner circumferential surface 7*a* of the case 7 and (the outer circumferential surface of) the small diameter portion 37 of the mount member 5. The globe 9 is secured to the case 7 by the adhesive material 41 disposed in the space between the case 7 and the small diameter portion 37. The mount member 5 is also secured to the case 7 by the adhesive material 41.

(7) Base Member 15

The base member 15 is attached to a socket of the lighting fixture to receive power supply via the socket. In the present embodiment, the base member 15 is made up of (i) a base portion 91 (corresponding to the "base" of the present invention), which is an Edison screw, and (ii) an externally fit portion 93 that is attached to an end of the base portion 91 at an opening of the base portion 91 and is fit around the outer circumferential surface of the protruding cylindrical portion 57 of the circuit holder 13.

The externally fit portion 93 has an annular shape. The inner diameter of the externally fit portion 93 fits the outer diameter of the protruding cylindrical portion 57. The externally fit portion 93 includes a case contact region 95 and a holder contact region 97. When the externally fit portion 93 has been attached to (fit around) the protruding cylindrical portion 57, the case contact region 95 and the holder contact region 97 come in contact with an outer surface of the bottom wall 47 of the case 7 and the protruding cylindrical portion 57, respectively.

The base portion 91 is made up of (i) a shell 98 with a thread and (ii) an electrical contact (eyelet) 99 positioned at a tip of the base portion 91. The external thread 57*a* formed on the outer circumferential surface of the protruding cylindrical portion 57 of the circuit holder 13 is screwed and fit into the shell 98. Note that the illustration of a connector line that electrically connects between the lighting circuit 11 and the base portion 91 is omitted from FIG. 1

2. Embodiment Examples

The LED light bulb 1 pertaining to First Embodiment may be implemented as, for example, a 60-watt incandescent light bulb or a 40-watt incandescent light bulb. Hereinafter, an LED light bulb equivalent to a 60-watt incandescent light bulb is referred to as a "60-watt equivalent", and an LED light bulb equivalent to a 40-watt incandescent light bulb is referred to as a "40-watt equivalent".

(1) LED Module 3

By way of example, the substrate body 23 of the substrate 17 may be made of a resin material, a ceramic material, or the like. It is preferable that the substrate body 23 be made of a material having high thermal conductivity. The substrate body 23 has a thickness of 1 (mm).

The substrate body 23 has a square shape in planar view. In the 40-watt equivalent, each side of the square substrate body 23 has a length of 21 (mm). In the 60-watt equivalent, each side of the square substrate body 23 has a length of 26 (mm). Therefore, a contact area S2 of a portion of the mount member 5 that is in contact with the substrate 17 is 441 ($mm^2$) in the 40-watt equivalent and 676 ($mm^2$) in the 60-watt equivalent.

In a case where the LED light bulb 1 is intended to replace an incandescent light bulb, GaN LEDs that emit blue light may be used as the LEDs 19, for example. In this case, a silicone resin or the like is used as the translucent material, and YAG phosphors ($(Y,Gd)_3Al_5O_{12}:Ce^{3+}$), silicate phosphors ($(Sr,Ba)_2SiO_4:Eu^{2+}$), nitride phosphors ($(Ca,Sr,Ba)AlSiN_3:Eu^{2+}$), or oxinitride phosphors ($Ba_3Si_6O_{12}N_2:Eu^{2+}$) may be used as the conversion material. Consequently, the LED module 3 emits while light.

The LEDs 19 are mounted on the substrate 17 in a matrix, a shape of multiple circles, a polygonal shape, a cross shape, etc. The number of the LEDs 19 is determined depending on the luminance, etc. of the incandescent light bulb to replace. For example, in the 60-watt equivalent, there are a total of ninety-six LEDs 19 that are divided into four groups. Each group includes twenty-four LEDs 19 that are connected in series with one another. The four groups are connected in parallel with one another. On the other hand, in the 40-watt equivalent, there are a total of forty-eight LEDs 19 that are divided into two groups. Each group includes twenty-four LEDs 19 that are connected in series with one another. The two groups are connected in parallel with each other.

(2) Mount Member 5

The mount member 5 is made of a material with high thermal conductivity, such as aluminum. A portion of the mount member 5 on which the LED module 3 is mounted has a thickness of 3 (mm). The large diameter portion 39 inside the case 7 has a thickness of 3 (mm). The outer diameter of the large diameter portion 39 is 37 (mm) in the 40-watt equivalent, and 52 (mm) in the 60-watt equivalent. Thus, a contact area S1 of a portion of the mount member 5 that is in contact with the case 7 is 349 ($mm^2$) in the 40-watt equivalent, and 490 ($mm^2$) in the 60-watt equivalent.

A contact area fraction S1/S2 is 0.79 in the 40-watt equivalent and 0.72 in the 60-watt equivalent, where S1 denotes the contact area of the portion of the mount member 5 that is in contact with the case 7, and S2 denotes the contact area of the portion of the mount member 5 that is in contact with the substrate 17 of the LED module 3.

It is preferable that the contact area fraction S1/S2 be in a range of 0.5 to 1.0 inclusive. When the contact area fraction S1/S2 is in the above range, the weight of the LED light bulb 1 can be reduced and favorable heat dissipation properties can be obtained as described later.

(3) Case 7

The case 7 is made of a material with high thermal radiation properties, such as aluminum. The case 7 has a wall thickness in a range of 0.3 (mm) to 0.35 (mm) inclusive.

The size of the case 7 varies depending on the type of the incandescent light bulb to replace.

Figures 5A, 5B, 5C:
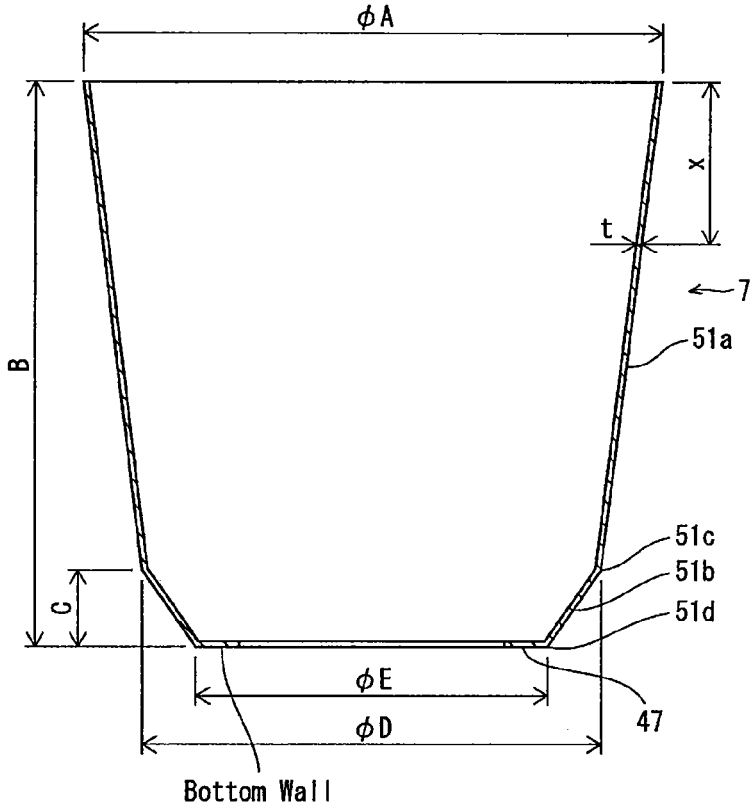
FIGS. 5A, 5B and 5C show the wall thicknesses of different portions of a case.

FIGS. 5A, 5B and 5C show the measurements of different portions of the case.

The case 7 has a cylindrical shape. As stated earlier, the case 7 includes a first sloped cylindrical portion 51*a*, a second sloped cylindrical portion 51*b*, and the bottom wall 47. The case 7 also includes a first bent portion 51*c* between the first sloped cylindrical portion 51*a* and the second sloped cylindrical portion 51*b*, and a second bent portion 51*d* between the second sloped cylindrical portion 51*b* and the bottom wall 47.

The measurement of each portion of the case 7 is shown in FIG. 5B.

Referring to FIG. 5C, a wall thickness of the case 7 in the 40-watt equivalent is labeled t. A distance x is measured from a first end of the case 7 at the large opening. By design, a portion of sample 1 that satisfies the relationship x=5 (mm) to 25 (mm) (equivalent to the "portion" of the present invention), as well as a portion of sample 2 that satisfies the relationship x=5 (mm) to 20 (mm) (equivalent to the "portion" of the present invention), decrease in wall thickness from the first end (the upper end in FIG. 5A) toward a second end of the case 7.

The first end portion of the case 7 at the large opening has a thick wall thickness, because it is especially likely to be subject to a force applied by, for instance, holding the case 7 during/after the manufacturing process. This way, the first end portion of the case 7 is not easily deformed. Furthermore, since the wall thickness of the case 7 decreases toward the second end of the case 7 at the small opening, the weight of the LED light bulb 1 can be reduced.

The case 7 has the thinnest wall thickness between (i) a central area between the first end of the case 7 at the large opening and the first bent portion 51*c* and (ii) the first bent portion 51*c*. This portion of the case 7 with the thinnest wall thickness is away from the first end of the case 7 at the large opening by 20 (mm) to 25 (mm) inclusive (a ratio of the length of this portion of the case 7 to the total length of the case 7 is in a range of 0.57 to 0.71 inclusive).

The bent portions 51*c* and 51*d* provide the effect of a beam. Hence, by making said portion of the case 7 with the thinnest wall thickness close to the bent portions 51*c* and 51*d*, it is possible to suppress deformation of the case 7 caused by the thinness of the case 7. The above structure, in which the bent portions 51*c* and 51*d* do not have the thinnest wall thickness, can prevent damage during formation/processing of the bent portions 51*c* and 51*d* in the case 7.

The surface of the case 7 is anodized. As a result, an anodized layer having a thickness of 10 (μm) lies on the surface of the case 7. The anodization of the surface of the case 7 does not affect the volume and weight of the case 7, because the anodized layer has a thin film thickness. High heat dissipation properties can be achieved even when the case is made with a thin wall thickness for the purpose of size/weight reduction as in the present embodiment examples. By thus combining the above techniques, it is possible to achieve the conflicting features, namely high heat dissipation properties and size/weight reduction.

In a case where the case 7 is made of aluminum as in the present embodiment examples, the anodized layer can be formed by anodizing the surface of the case 7. Hence, in such a case, problems associated with application of other materials such as paint to the surface of the case 7 (e.g., abrasion) would not occur, and a simple layer-forming process can be performed.

(4) Circuit Holder 13

For the purpose of weight reduction, the circuit holder 13 is made of a material with low relative density, such as a synthetic resin (more specifically, polybutylene terephthalate (PBT)).

The cap and the cylindrical body each have a thickness of 0.8 (mm).

In a central area of the case 7 along the central axis direction of the case 7, the clearance between the circuit holder 13 and the case 7 is 0.5 (mm). Therefore, for instance, even if a compressive load (a load that would dent the case 7) acts on the central area of the case 7 for some reason, the deformed central area of the case 7 would come in contact with the circuit holder 13 during the deformation, which stops progress of the deformation. If this deformation is elastic deformation, then the dented central area of the case 7 will revert to its original shape once the compressive load is lifted.

It is permissible to configure the LED light bulb 1 so that there is no clearance between the circuit holder 13 and the case 7.

By processing the inner surface of the case 7 with the use of an insulation member, insulation between the case 7 and the lighting circuit 11 can be guaranteed without the circuit holder 13. Further size/weight reduction can be achieved if the circuit holder 13 is not provided in the LED light bulb 1.

(5) Base Portion 91

The base portion 91 is of the same type as a base of a conventional incandescent light bulb. To be more specific, an E26 base is used as the base portion 91 in the 60-watt equivalent, and an E17 base is used as the base portion 91 in the 40-watt equivalent.

3. Case (1) Wall Thickness

The portion of the case 7 at or around the large opening (in FIG. 5C, the portion of the case 7 that satisfies the relationship x=0 (mm) to 5 (mm)) should have a wall thickness, due to which it has sufficient stiffness to avoid deformation (e.g., crushing). This portion is referred to as a first portion. In a case where the case 7 is made of aluminum, such a wall thickness that would prevent deformation of the first portion of the case 7 is in a range of 200 (μm) to 500 (μm) inclusive.

Using such a thin material for the case 7 makes it possible to secure an internal space—i.e., a space in which a circuit holder is disposed—whose shape is similar to the external shape of the case 7. That is to say, the above-described wall thickness is suitable for the size/weight reduction because it allows the external shape of the case to be of a minimum size in accordance with the circuit space.

Meanwhile, as shown in FIG. 5C, the wall thickness of the case 7 decreases from the first end thereof at the large opening toward the first bent portion 51*c*.

This portion of the case 7 between the first end thereof at the large opening and the first bent portion 51*c* is referred to as a second portion, and is equivalent to the first sloped cylindrical portion 51*a* and to the central area of the case 7 in the central axis direction of the case 7. This second portion of the case 7 is often held by a user when attaching the LED light bulb 1 to the lighting fixture—or more specifically, when screwing the base portion 91 of the LED light bulb 1 into the socket of the lighting fixture to attach the LED light bulb 1 to the lighting fixture.

Therefore, the first sloped cylindrical portion 51*a* should have a wall thickness, due to which it has sufficient stiffness to avoid deformation (denting) even when it is held by the user. In a case where the case 7 is made of aluminum, a wall thickness of the first sloped cylindrical portion 51*a* that would avoid deformation is in a range of 250 (μm) to 350 (μm) inclusive, which is thinner than the wall thickness of the above-described first portion of the case 7.

The above structure reduces the possibility that the first end portion of the case 7 at the large opening is deformed during assembly of the LED light bulb 1 or shipping of the case 7 as a component of the LED light bulb 1. This improves handleability of the LED light bulb 1 and the case 7.

In the present embodiment examples, the bent portions 51*c* and 51*d* are positioned at two different locations. However, it is permissible to provide one or more additional bent portions in the sloped cylindrical portions 51*a* and 51*b* to increase the number of bent portions. This way, the case 7 is not easily deformed.

The inner circumferential surface 7*a* of the first end portion of the case 7 at the large opening, and the outer circumferential surface 39*a* of the large diameter portion 39 of the mount member 5, have the same angle of slope. Accordingly, the mount member 5 can be attached to the case 7 by pushing the mount member 5 into the case 7. In this case, for example, even if the outer diameter of the mount member 5 and the inner diameter of the case 7 vary in different LED light bulbs, the outer circumferential surface 39*a* of the mount member 5 and the inner circumferential surface 7*a* of the case 7 come in contact with each other without fail, as long as the wall thickness of the case 7 falls within the above-described ranges. This is because the first end portion of the case 7 at the large opening changes its shape when pushing (or pressing) the mount member 5 into the case 7. This way, the physical connection between the case 7 and the mount member 5 can be enhanced, and the heat of the mount member 5 can be efficiently and surely conducted to the case 7.

The second sloped cylindrical portion 51*b* is positioned between the first bent portion 51*c* and the second bent portion 51*d*. The bottom wall 47 extends from the second bent portion 51*d* toward the central axis of the case 7. Accordingly, the second sloped cylindrical portion 51*b* and the bottom wall 47 have higher stiffness than the second region, and therefore can avoid deformation.

(2) Heat Dissipation Properties

In the present First Embodiment, the outer surface of the case 7 is anodized. The following describes the relationship between anodization and heat dissipation properties.

FIGS. 6A and 6B show effects of anodization on heat dissipation properties. The data of FIG. 6A pertains to the 40-watt equivalent, and the data of FIG. 6B pertains to the 60-watt equivalent.

The effects on heat dissipation properties are evaluated in terms of a junction temperature (indicated as "Tj" in FIGS. 6A and 6B) measured while the LEDs 19 are being lit so that the LED light bulb 1 provides desired luminous flux. The anodized layer has a thickness of 5 (μm).

The following describes the data pertaining to the 40-watt equivalent.

As shown in FIG. 6A, when the outer surface of the case 7 is not anodized, the case 7 has an emissivity of 0.05, and the junction temperature of the LEDs 19 is 116 (° C.).

On the other hand, when the outer surface of the case 7 is white anodized, the case 7 has an emissivity of 0.8, which is 16 times higher than the emissivity of the case 7 whose outer surface is not anodized. Furthermore, when the outer surface of the case 7 is white anodized, the junction temperature of the LEDs 19 is 98.5 (° C.), which is as much as 17.5 (° C.) lower than the junction temperature of the LEDs 19 measured when the outer surface of the case 7 is not anodized. The above emissivity is calculated under the assumption that a black body has an emissivity of 1.

Meanwhile, when the outer surface of the case 7 is black anodized, the case has an emissivity of 0.95, which is 19 times higher than the emissivity of the case 7 whose outer surface is not anodized. Furthermore, when the outer surface of the case 7 is black anodized, the junction temperature (Tj) of the LEDs 19 is 95 (° C.), which is as much as 21 (° C.) lower than the junction temperature of the LEDs 19 measured when the outer surface of the case 7 is not anodized. The heat dissipation properties of the case 7 are higher when the outer surface of the case 7 is black anodized than when the outer surface of the case 7 is white anodized.

In view of heat dissipation properties, the outer surface of the case 7 is preferably black anodized. On the other hand, in view of absorption of visible light by the outer surface of the case 7, the outer surface of the case 7 is preferably white anodized, which offers high visible light reflectivity. It is possible to make use of one of black anodizing and white anodizing depending on a lighting fixture, etc. to which the LED light bulb 1 is to be attached.

The following describes the data pertaining to the 60-watt equivalent. The difference between the emissivities of anodized and unanodized outer surfaces found in the 60-watt equivalent is the same as that found in the 40-watt equivalent. Therefore, the following provides a description of the junction temperature.

As shown in FIG. 6B, when the outer surface of the case 7 is not anodized, the junction temperature of the LEDs 19 is 101 (° C.).

On the other hand, when the outer surface of the case 7 is white anodized, the junction temperature of the LEDs 19 is 82 (° C.), which is as much as 19 (° C.) lower than the junction temperature of the LEDs 19 measured when the outer surface of the case 7 is not anodized. Meanwhile, when the outer surface of the case 7 is black anodized, the junction temperature of the LEDs 19 is 78 (° C.), which is as much as 23 (° C.) lower than the junction temperature of the LEDs 19 measured when the outer surface of the case 7 is not anodized. In the case of the 60-watt equivalent also, the heat dissipation properties of the case 7 are higher when the outer surface of the case 7 is black anodized than when the outer surface of the case 7 is white anodized.

As the envelope volume of the case 7 in the 40-watt equivalent is smaller than that of the case 7 in the 60-watt equivalent, the heat is less easily dissipated from the former case 7 than from the latter case 7. This is presumably why the LEDs 19 in the 40-watt equivalent, to which a smaller amount of power is supplied, has a higher junction temperature than the LEDs 19 in the 60-watt equivalent.

As described above, heat dissipation properties of the case 7 can be improved by anodizing the outer surface of the case 7. Furthermore, with this structure, the case 7 can maintain high heat dissipation properties even if it is made with a thin wall thickness.

4. Assembly

Figure 7C:
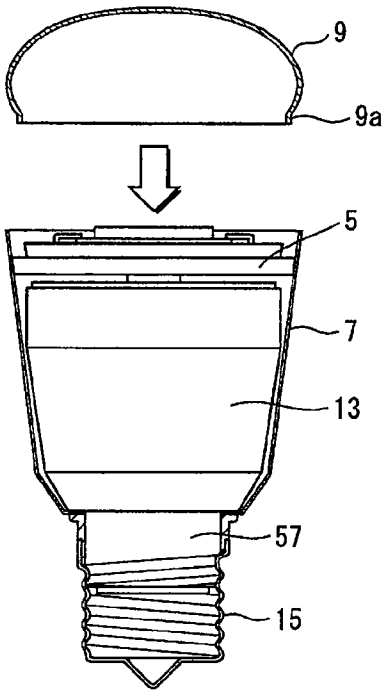
FIGS. 7A, 7B and 7C show a method for assembling an LED light bulb pertaining to First Embodiment.
Figure 7B:
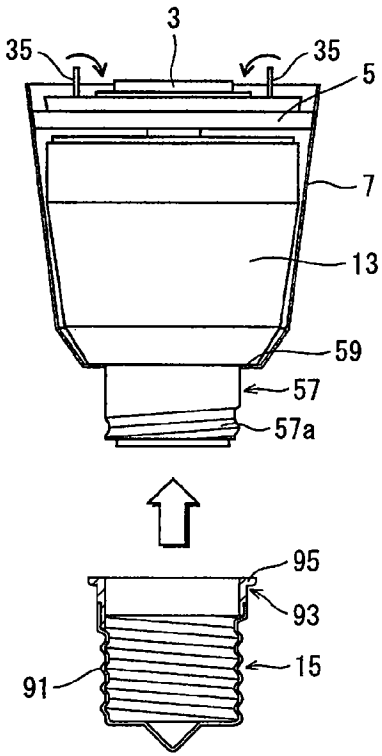
Figure 7A:
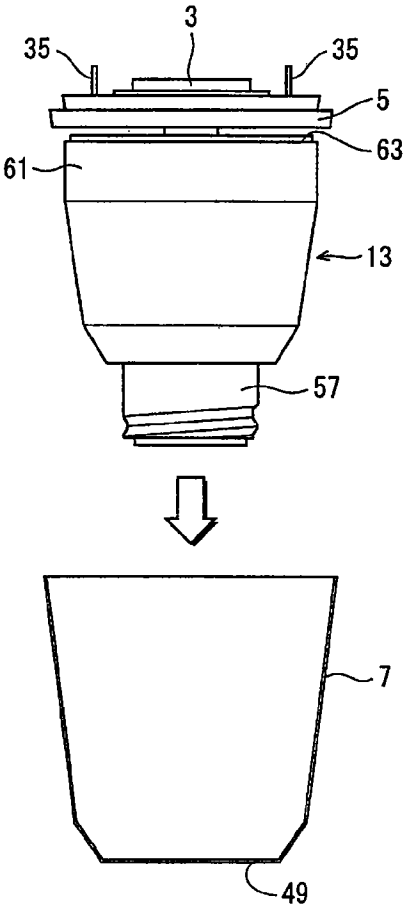

FIGS. 7A, 7B and 7C show a method for assembling the LED light bulb pertaining to First Embodiment.

First, the mount member 5, on which the LED module 3 is mounted, is connected to the cap 63 of the circuit holder 13 by the connector member 75. Next, the substrate 81 of the lighting circuit 11 is attached to the cap 63 of the circuit holder 13, and the cylindrical body 61 is attached to the cap 63. Through the above procedure, assembly (connection) of the mount member 5 and the circuit holder 13 is completed.

Then, as shown in FIG. 7A, the protruding cylindrical portion 57 of the circuit holder 13 is inserted into the case 7, so that it eventually penetrates through the small opening 49 and protrudes toward the outside of the case 7. Thereafter, the mount member 5 is pushed into the first end portion of the case 7 at the large opening. Next, in order to prevent the mount member 5 from falling off the case 7, a protrusion is provided on the inner circumferential surface of the case 7 by denting a portion of the case 7 that corresponds to the upper edge of the mount member 5 (the edge of the mount member 5 close to the large opening of the case 7) from the outer surface of the case 7 with the use of a punch, etc.

Here, the case 7 is made of aluminum, and a wall thickness of the case 7 is in a range of 300 (μm) to 500 (μm) inclusive in the first end portion, and in a range of 250 (μm) to 350 (μm) inclusive in the central area. Therefore, the possibility of the case 7 getting deformed during the assembly is reduced.

Furthermore, since the inner circumferential surface 7*a* of the first end portion of the case 7 at the large opening has the same angle of slope as the outer circumferential surface 39*a* of the large diameter portion 39 of the mount member 5, it is possible to bring the mount member 5 in contact with the case 7 by lightly inserting the mount member 5 into the case 7. At this time, even if there is clearance between the mount member 5 and the case 7 due to variations resulting from processing of the mount member 5 and the case 7, it is ultimately possible to bring the mount member 5 in contact with the case 7 without fail, because the case 7 would change its shape when pressing the mount member 5 thereinto. Consequently, stable connection strength can be obtained.

Next, one end of each power supply path 35 is electrically connected to the LED module 3, and the protruding cylindrical portion 57 is covered with the base member 15. Thereafter, the base member 15 is screwed along the external thread 57*a* on the outer circumferential surface of the protruding cylindrical portion 57. As the base member 15 is screwed and fit around the external thread 57*a*, the base member 15 approaches the bottom wall 47 of the case 7. By further rotating the base member 15, the bottom wall 47 of the case 7 is held between the contact portion 59 of the circuit holder 13 and the externally fit portion 93 (the case contact region 95) of the base member 15. Through the above procedures, attachment of the circuit holder 13 and the mount member 5 to the case 7 is completed.

Next, as shown in FIG. 7C, the tip 9*a* of the globe 9 at the opening of the globe 9 is inserted in the space between the case 7 and the mount member 5. Thereafter, the tip 9*a* of the globe 9 is secured by the adhesive material (41). This completes the assembly of the LED light bulb 1.

When assembling together the case 7, the circuit holder 13 and the base member 15, the above-described method allows holding the bottom wall 47 of the case 7 between the circuit holder 13 and the base member 15, which approach each other by the former being screwed and fit into the latter. As the above-described method does not require an adhesive material or the like, it allows for an efficient and low-cost assembly.

Also, because the inner circumferential surface 7*a* of the first end portion of the case 7 at the large opening has the same angle of slope as the outer circumferential surface 39*a* of the large diameter portion 39 of the mount member 5, it is possible to bring the mount member 5 in contact with the case 7 without fail, by lightly inserting the mount member 5 into the case 7. This allows for efficient conduction of heat from the mount member 5 to the case 7.

At this time, the cap 63 of the circuit holder 13 is attached to the cylindrical body 61 in such a manner that it is movable in the central axis direction of the circuit holder 13 (equivalent to the central axis direction of the case 7 and the direction along which the mount member 5 is inserted into the case 7). With this structure, it is permissible that the position of the mount member 5 within the case 7 changes (i.e., variation due to processing) as a result of variances in the inner diameter of the first end portion of the case 7 at the large opening, the outer diameter of the large diameter portion 39 of the mount member 5, the thickness of the mount member 5, etc.

Furthermore, the circuit holder 13 is attached to the case 7, and the mount member 5 is connected to the circuit holder 13. As a result, the mount member 5 is secured to the case 7, which can prevent the mount member 5 from falling off the case 7 ahead of time.

5. Other Remarks (1) Thermal Conductivity

According to the LED light bulb 1 pertaining to First Embodiment, the heat generated in the LED module 3 while the LED module 3 is being lit (while the LED module 3 is emitting light) is conducted from the LED module 3 to the mount member 5, and from the mount member 5 to the case 7.

The following describes a relationship between the thickness and thermal conductivity of the mount member.

To be more specific, the inventors of the present invention created different sample LED light bulbs. Each of the sample LED light bulbs had the same contact area at which the mount member and the case were in contact with each other, and the same contact area at which the LED module and the mount member were in contact with each other. However, portions of the mount members on which the LED modules were mounted were different in thickness between the sample LED light bulbs (see FIG. 8A). The inventors supplied power of different watts to the sample LED light bulbs, and measured the junction temperature of the LEDs for each watt.

Figure 8A:
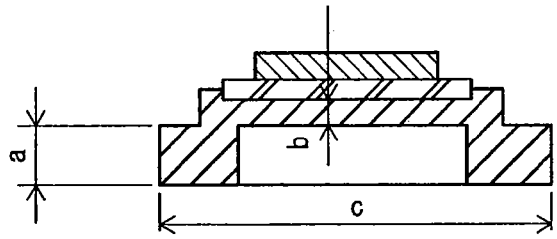
FIGS. 8A and 8B illustrate the relationship between the thickness and thermal conductivity of a mount member.
Figure 8B:
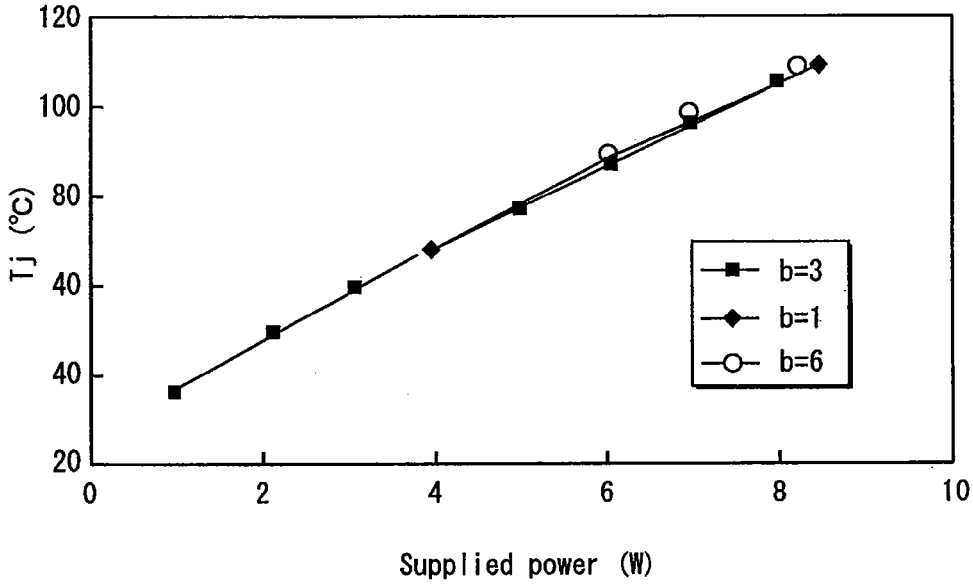

FIGS. 8A and 8B illustrate the relationship between the thickness and thermal conductivity of the mount member. FIG. 8A illustrates one example of the mount members used in the test, and FIG. 8B shows measurement results obtained from the test.

Each of the mount members used in the test had a shape of a disk having an outer diameter of 38 (mm) and was made of aluminum (the outer diameter is denoted as "c" in FIG. 8A). Also, the cases used in the test had the following measurements. Portions of the cases at which the mount members were attached had an inner diameter of 38 (mm), an outer diameter of 40 (mm), a wall thickness of 1 (mm), and an envelope volume of approximately 42 (cc). The cases were made of aluminum. None of the cases used in the test was anodized.

The inventors prepared three types of mount members. The portions of these mount members on which the LED modules were mounted had thicknesses "b" of 1 (mm), 3 (mm) and 6 (mm), respectively (see FIG. 8A). In each of the mount members, an area of a portion of the mount member that was in contact with the case (i) had a height "a" of 4 (mm) in the central axis direction of the case, and (ii) was 480 ($mm^2$). In each of the mount members, an area of a portion of the mount member that was in contact with the LED module was 440 ($mm^2$).

Each of the LED modules (to be exact, substrates) had a shape of a square with each of its sides being 21 (mm). Each of the substrates had a thickness of 1 (mm).

As shown in FIG. 8B, in each of the three mount members 5, the junction temperature of the LEDs measured while the sample LED light bulb was being lit had a tendency to rise as the power supplied to the sample LED light bulb increased, regardless of the thicknesses "b" of the mount members 5. It is presumed that the actual power to be supplied to the sample LED light bulbs used in the test is in a range of 4 (W) to 8 (W) inclusive.

Furthermore, the measurement results show that when the same power is supplied to the sample LED light bulbs, the difference in the thicknesses of the mount members 5 causes almost no difference in the junction temperatures of the LEDs.

For the above reasons, in order to reduce weight of the LED light bulb, it is preferable that the mount member 5 be as thin as possible (the specifics of the thickness of the mount member 5 will be described later).

Hence, the mount member 5 should have a thickness that (i) allows the LED module 3 to be mounted thereon, and (ii) in a case where a press-in (push-in) method is employed to attach the mount member 5 to the case 7, gives the mount member 5 mechanical properties to resist the load applied by the press-in.

(2) Heat Dissipation Properties and Lightweight Properties

According to the LED light bulb 1 pertaining to First Embodiment, the heat generated in the LED module 3 while the LED module 3 is being lit (while the LED module 3 is emitting light) is conducted from the LED module 3 to the mount member 5, and from the mount member 5 to the case 7. The heat is then dissipated from the case 7 to the open air.

In view of the heat dissipation properties—i.e., dissipation of the heat generated in the LED module 3 from the case 7, it is preferable for the contact area fraction S1/S2 to be larger than or equal to 0.5, where S1 denotes an area of a portion of the mount member 5 that is in contact with the case 7, and S2 denotes an area of a portion of the mount member 5 that is in contact with the LED module 3.

Figure 9:
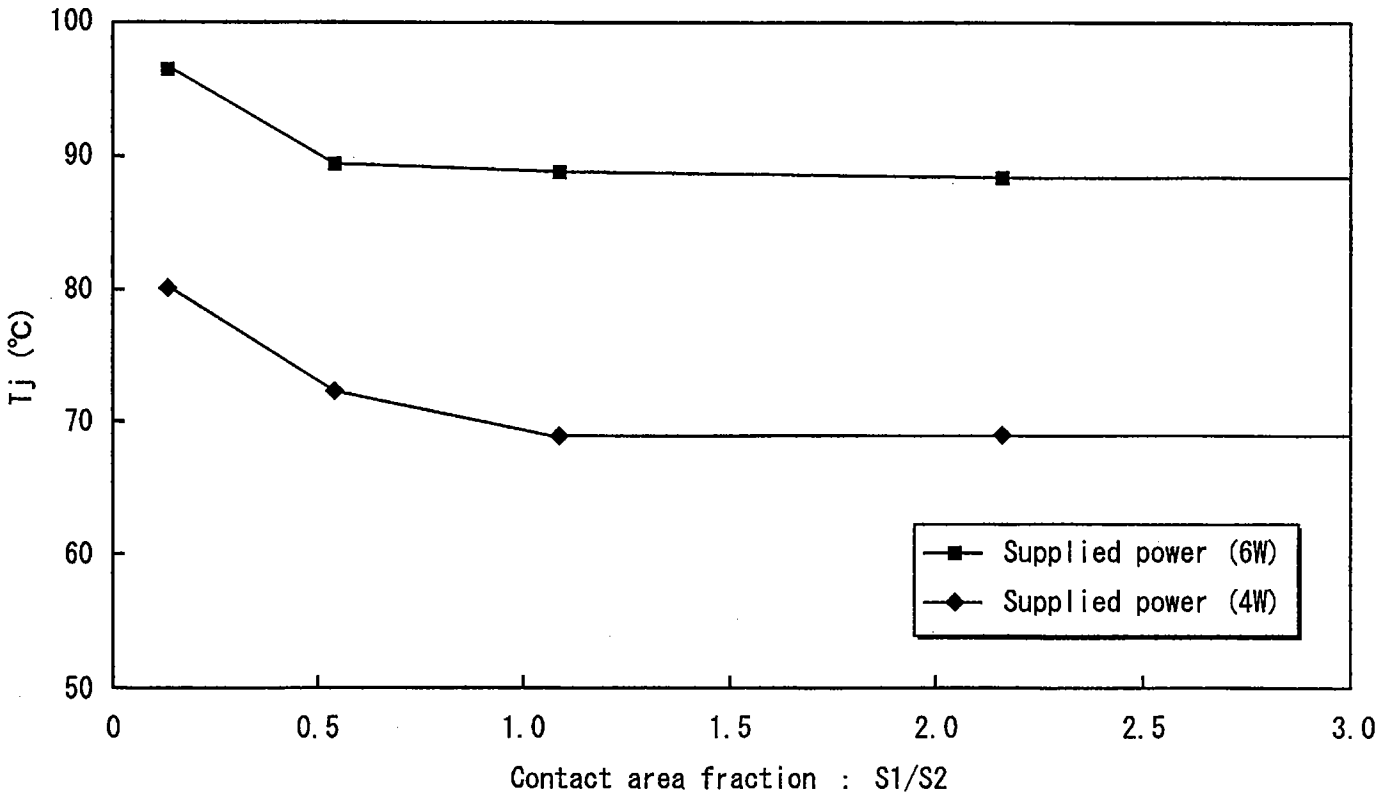
FIG. 9 shows how the temperature of LEDs is affected by the fraction of (i) an area of a portion of the mount member that is in contact with the case, to (ii) an area of a portion of the mount member that is in contact with the LED module.

FIG. 9 shows how the temperature of the LEDs is affected by the ratio of the area of the portion of the mount member that is in contact with the case to the area of the portion of the mount member that is in contact with the LED module.

In the test, the inventors lit the LED light bulb with two predetermined types of power supply, and measured/evaluated the junction temperature of the LEDs in the LED module for each type of power supply.

Four LED light bulbs were used in the test. The contact area fractions S1/S2 of the four LED light bulbs were 0.1, 0.5, 1.1 and 2.2, respectively. The two types of power supplied to the four LED light bulbs were 6-watt power and 4-watt power.

It is apparent from FIG. 9 that, both when the LED light bulbs were lit with a power supply of 6 (W) and when the LED light bulbs were lit with a power supply of 4 (W) (that is, regardless of the power supply), the junction temperature of the LEDs decreases as the contact area fraction S1/S2 increases.

It is also apparent from FIG. 9 that (i) when the contact area fraction S1/S2 is smaller than 0.5, the junction temperature of the LEDs decreases to a great extent as the contact area fraction S1/S2 changes, and (ii) when the contact area fraction S1/S2 is larger than or equal to 0.5, the decrease in the junction temperature of the LEDs is moderate despite of the increase in the contact area fraction S1/S2.

FIG. 9 further shows that when the contact area fraction S1/S2 is larger than or equal to 1.0, the junction temperature of the LEDs barely decreases even if the contact area fraction S1/S2 increases. The junction temperature of the LEDs barely decreases especially when the contact area fraction S1/S2 is large. The junction temperature of the LEDs measured when the contact area fraction S1/S2 is 1.0, and the junction temperature of the LEDs measured when the contact area fraction S1/S2 is 2.2, have a difference of 1° C. or lower—i.e., there is almost no difference in these junction temperatures.

There is almost no change in the junction temperature of the LEDs when the contact area fraction S1/S2 is larger than or equal to 2.5. It is assumed that there is no decrease in the junction temperature of the LEDs when the contact area fraction S1/S2 is larger than 3.0.

Regarding the heat dissipation properties, the above test results indicate that the contact area fraction S1/S2 is preferably 0.5 or larger, or more preferably, 1.0 or larger.

In order to increase the contact area ratio S1/S2 (e.g., 1.0 or more), it is necessary to either (i) increase the contact area S1 of the portion of the mount member that is in contact with the case, or (ii) decrease the contact area S2 of the portion of the mount member that is in contact with the LED module.

With regard to the contact area S2, in some cases it is difficult to reduce the size of the LED module (substrate) depending on the size and the number of the LEDs mounted thereon. Accordingly, it is relatively easy to increase the contact area fraction S1/S2 by increasing the contact area S1 of the portion of the mount member that is in contact with the case.

However, since the size of the case is predetermined, increase in the contact area S1 of the portion of the mount member that is in contact with the case ultimately leads to increase in the weight of the mount member.

For the above reasons, in view of both heat dissipation properties and lightweight properties, the contact area fraction S1/S2 is preferably in a range of 0.5 to 1.0 inclusive.

In a case where a plurality of LED modules are mounted, the contact area S2 is a sum of areas of portions of the mount member that are in contact with the plurality of LED modules.

(3) Mount Member and Case

First Embodiment has not provided specific descriptions about the relationship between the thicknesses of the mount member 5 and the wall thickness of the case 7. However, it is preferable that the thickness of the portion of the mount member 5 on which the LED module 3 is mounted be greater than the wall thickness of the case 7. This is due to a difference between the function of the portion of the mount member 5 on which the LED module 3 is mounted and the function of the case 7.

To be more specific, the portion of the mount member 5 on which the LED module 3 is mounted needs to store heat from the LED module 3, at least temporarily, and therefore to have both (i) the function of storing the heat and (ii) the function of allowing conduction of the heat. In contrast, the case 7 does not need to have the function of storing the heat, because once the heat generated in the LEDs 19 has been conducted from the mount member 5 to the case 7, the heat is dissipated from the case 7 to the open air.

Therefore, although it is not necessary to make the case 7 with a thick wall thickness, it is preferable for the thickness of the portion of the mount member 5, on which the LED module is mounted and which needs to have the function of storing the heat, to be greater than the wall thickness of the case 7. In other words, the wall thickness of the case 7 can be thinner than the thickness of the mount member 5. This way, the weight of the case 7 can be reduced.

It is preferable that the thickness of a portion of the mount member 5 that is in contact with the LED module 3 (to be exact, the substrate 17) be (i) greater than or equal to the thickness of the substrate 17 of the LED module 3, and (ii) smaller than or equal to a thickness that is three times the thickness of the substrate 17 of the LED module 3, for the following reasons. In a case where a total length of the LED light bulb 1 is predetermined, if the thickness of the portion of the mount member 5 that is in contact with the LED module 3 is greater than a thickness that is three times the thickness of the substrate 17, then sufficient clearance cannot be provided between the lighting circuit 11 (circuit holder 13) and the mount member 5. This increases the possibility that the heat poses a detrimental effect on the electronic components 83 and the like constituting the lighting circuit 11. On the other hand, if the thickness of the portion of the mount member 5 that is in contact with the LED module 3 is smaller than the thickness of the substrate 17, then the mount member 5 will not have sufficient mechanical properties to allow the LED module 3 to be mounted thereon.

[Second Embodiment]

In Second Embodiment, the case has been anodized to improve its emissivity. This way, the case can be made with a thin wall thickness while preserving the heat dissipation properties.

Figure 10:
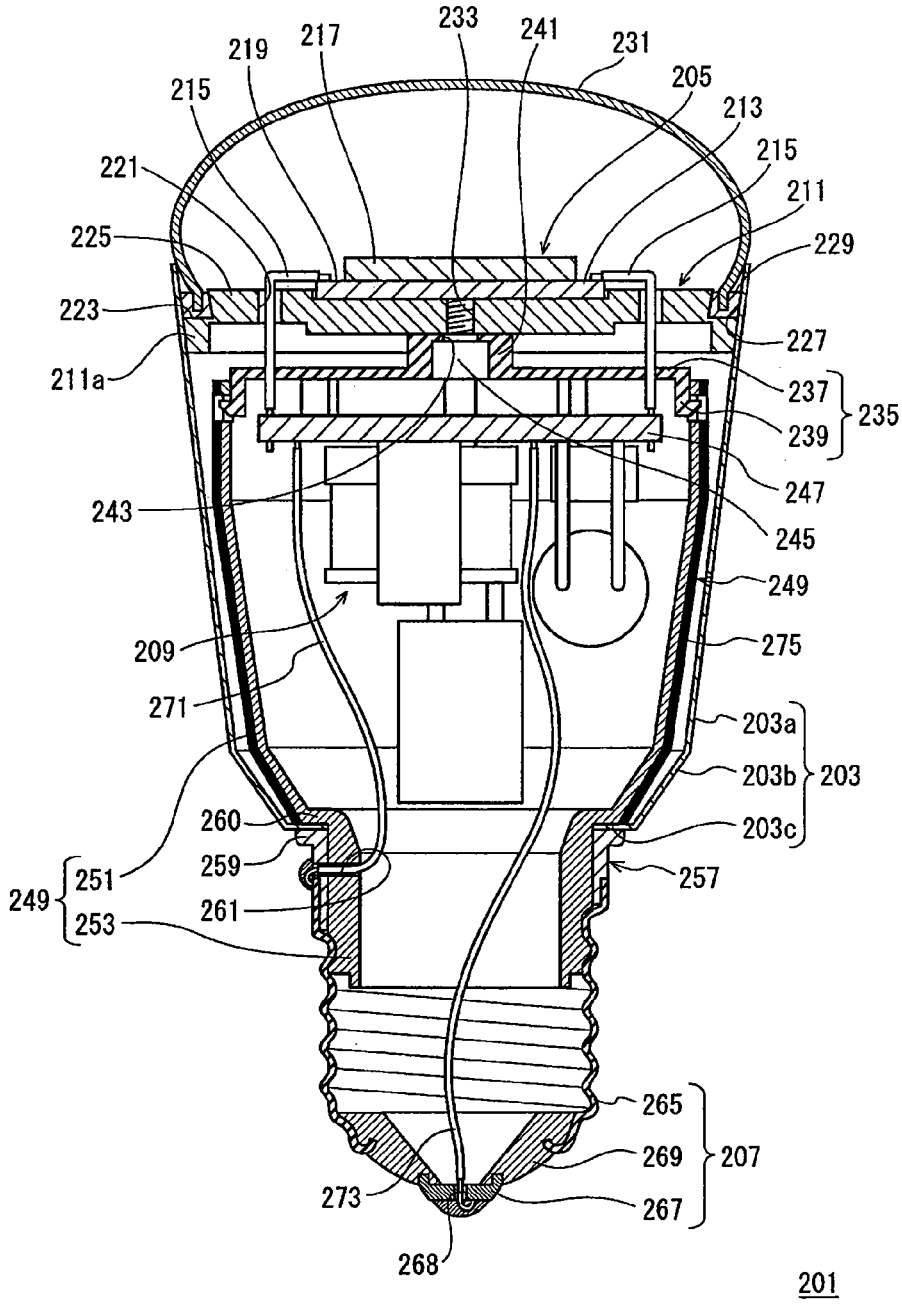
FIG. 10 is a longitudinal cross-sectional view showing a general structure of an LED light bulb pertaining to Second Embodiment of the present invention.

FIG. 10 is a longitudinal cross-sectional view showing a general structure of an LED light bulb 201 pertaining to Second Embodiment of the present invention.

The LED light bulb 201 includes, as major structural components, a case 203, an LED module 205, a base member 207, and a lighting circuit 209. The case 203 has a cylindrical shape. The LED module 205 is attached to a first end portion of the case 203 in a longitudinal direction of the case 203. The base member 207 is attached to a second end portion of the case 203. The lighting circuit 209 is positioned inside the case 203.

The case 203 is made up of a first tapered portion 203*a*, a second tapered portion 203*b* and a bottom portion (bent portion) 203*c*. A diameter of the first tapered portion 203*a* decreases from a first end toward a second end of the case 203. The second tapered portion 203*b* extends from the first tapered portion 203*a*. A diameter of the second tapered portion 203*b* decreases toward the second end of the case 203 at a larger taper angle than the first tapered portion 203*a*. The bottom portion 203*c* is formed by bending the case 203. The bottom portion 203*c* is contiguous with one end of the second tapered portion 203*b* and extends inward. Cross sections of the first tapered portion 203*a* and the second tapered portion 203*b* along a direction perpendicular to the central axis of the case 203 have a circular shape. The bottom portion 203*c* has an annular shape. As will be described later, a material with high thermal conductivity (e.g., aluminum) is used as a base material of the case 203, so that the case 203 functions as a heat dissipation member (heat sink) that allows dissipation of the heat from the LED module 205. In order to reduce the weight of the entirety of the LED light bulb 201, the case 203 is formed in the shape of a cylinder having a thin wall thickness. The specifics of the wall thickness of the case 203 will be described later.

The LED module 205 is mounted within (attached to) the case 203 via the mount member (attachment member) 211. The mount member 211 is made of a material with high thermal conductivity, such as aluminum. As will be described later, due to the properties of its material, the mount member 211 also functions as a heat conduction member that allows conduction of heat from the LED module 205 to the case 203.

The LED module 205 comprises a substrate 213 having a quadrilateral shape (in the present example, a square shape). A plurality of LEDs are mounted on the substrate 213. These LEDs are connected in series with one another by a wiring pattern (not illustrated) of the substrate 213. Of all the LEDs that are connected in series with one another, an anode electrode (not illustrated) of an LED located at an end point with high electric potential is electrically connected to one of terminal portions (25*b*, see FIG. 3) of the wiring pattern, and a cathode electrode (not illustrated) of an LED located at another end point with low electric potential is electrically connected to the other one of the terminal portions (25*b*, see FIG. 3). By supplying power from both of the terminal portions, the LEDs emit light. Each power supply path 215 has its one end soldered to a different one of the terminal portions. Power is supplied from the lighting circuit 209 via each power supply path 215.

By way of example, GaN LEDs that emit blue light may be used as the LEDs. The LED module 205 may be composed of only one LED. When the LED module 205 is composed of a plurality of LEDs, the LEDs are not limited to being connected in series with one another as described in the above example. Alternatively, the LEDs may be connected with one another by using a so-called series-parallel connection. In this case, the LEDs are divided into multiple groups so that each group includes a predetermined number of LEDs, with one of the following conditions (i) and (ii) satisfied: (i) the LEDs included in each group are connected in series with one another, and the groups are connected in parallel with one another; and (ii) the LEDs included in each group are connected in parallel with one another, and the groups are connected in series with one another.

The LEDs are sealed by a sealing member 217. The sealing member 217 is made of a translucent material through which light from the LEDs is transmitted. In a case where the wavelength of the light from the LEDs needs to be converted to a predetermined wavelength, the sealing member 217 is made of the translucent material and a conversion material. Resin is used as the translucent material. The resin may be, for example, a silicone resin. By way of example, powders of YAG phosphors ($(Y,Gd)_3Al_5O_{12}:Ce^{3+}$), silicate phosphors ($(Sr,Ba)_2SiO_4:Eu^{2+}$), nitride phosphors ($(Ca,Sr,Ba)AlSiN_3:Eu^{2+}$) or oxinitride phosphors ($Ba_3Si_6O_{12}N_2:Eu^{2+}$) may be used as the conversion material. Consequently, the LED module 205 emits while light.

The mount member 211 has a shape of a disk as a whole. The mount member 211 is made of a material with high thermal conductivity, such as aluminum. The mount member 211 also functions as a heat conduction member that allows the heat generated in the LED module 205 while the LED light bulb 201 is being lit to be conducted from the LED module 205 to the case 203.

A quadrilateral recess 219, in which the substrate 213 is fit, is formed in the central portion of one of main surfaces of the mount member 211. The LED module 205 is secured with the substrate 213 fit in the recess 219 and the back surface of the substrate 213 tightly in contact with the bottom surface of the recess 219. Here, the LED module 205 is secured by using an adhesive material. Alternatively, the LED module 205 may be secured by using a screw. In this case, a through hole is provided at a suitable position in the substrate 213 to allow the screw to penetrate through the through hole and be fastened into the mount member 211.

Insertion holes 221 are provided in the mount member 211. The power supply paths 215 pass through the insertion holes 221.

The mount member 211 is made up of a disk portion 225 and an annular portion 223 that is formed along the entire circumference of the disk portion 225. An upper surface of the annular portion 223 is closer to the base member 207 than an upper surface of the disk portion 225 (the main surface of the mount member 21) is. The annular portion 223 has a tapered outer circumferential surface 211*a*, which is equivalent to part of a surface of a cone and has substantially the same taper angle as the inner circumferential surface of the first tapered portion 203*a* of the case 203. The mount member 211 is secured to the case 203 with the tapered outer circumferential surface 211*a* of the annular portion 223 in tight contact with the inner circumferential surface of the first tapered portion 203*a*. The mount member 211 is secured to the case 203 by an adhesive material 229 filled in an annular groove 227, which is formed by the inner circumferential surface of the first end portion of the case 203, the outer circumferential surface of the disk portion 225, and the upper surface of the annular portion 223.

A tip of a globe 231 at an opening of the globe 231 is inserted in the annular groove 227. The globe 231 has a shape of a dome and covers the LED module 205. The globe 231 is secured to the case 203 and the mount member 211 by the adhesive material 229.

An internal thread 233 is formed in the center of the disk portion 225 of the mount member 211. The internal thread 233 is used to secure a cap 235, which holds the lighting circuit 209, to the mount member 211.

The cap 235 has a shape of a circular dish, and is made up of a circular bottom portion 237 and a circumferential wall portion 239 that vertically extends from a circumferential rim of the circular bottom portion 237. A boss 241 is formed in the center of the circular bottom portion 237, in such a manner that the boss 241 protrudes from the circular bottom portion 237 along the thickness direction of the circular bottom portion 237. A through hole 243 is provided in the bottom of the boss 241.

A screw with an external thread is inserted through the through hole 243 and screwed along the internal thread 233. The screw and the internal thread 233 that have mated with each other are collectively referred to as a connector member 245. The cap 235 is secured to the mount member 211 by the connector member 245.

The lighting circuit 209 is composed of a substrate 247 and a plurality of electronic components mounted on the substrate 247. The lighting circuit 209 is held by the cap 235 with the substrate 247 secured to the cap 235.

The lighting circuit 209 is held by the cap 235 according to the structure that will be described later with reference to FIG. 15.

For the purpose of weight reduction, it is preferable that the cap 235 be made of a material with low relative density, such as a synthetic resin. In the present example, the cap 235 is made of polybutylene terephthalate (PBT).

The cap 235 is attached to a cylindrical body 249 that encloses the lighting circuit 209 and is connected to the base member 207. Note that the cap 235 and the cylindrical body 249 together constitute the "circuit holder member" of the present invention. For the reason stated above, it is preferable that the cylindrical body 249 be made of a material similar to the material of the cap 235. In the present example, the cylindrical body 249 is made of polybutylene terephthalate (PBT).

Broadly speaking, the cylindrical body 249 is made up of a lighting circuit cover portion 251 and a protruding cylindrical portion (base attachment portion) 253. The lighting circuit cover portion 251 encloses the lighting circuit 209. The protruding cylindrical portion 253 extends from the lighting circuit cover portion 251 and has a smaller diameter than the lighting circuit cover portion 251.

The cylindrical body 249 is attached to the cap 235 in the same manner as described later with reference to FIG. 4.

The following describes how the cylindrical body 249 is secured to the case 203, and how the base member 207 is attached to the protruding cylindrical portion 253 of the cylindrical body 249.

The cylindrical body 249 is secured to the case 203 by using a flanged bushing 257. The flanged bushing 257 has an inner diameter, due to which it can be smoothly fit around the outer circumferential surface of the protruding cylindrical portion 253 without jouncing. The flanged bushing 257 is fit around and attached to the protruding cylindrical portion 253 with the bottom portion 203*c* of the case 203 held between a shoulder portion 260 of the cylindrical body 249 and a flange portion 259 of the flanged bushing 257, the shoulder portion 260 connecting between the lighting circuit cover portion 251 and the protruding cylindrical portion 253. Insertion holes 261, through which a first power supply wire 271 (described later) is inserted, are respectively provided in the protruding cylindrical portion 253 and the flanged bushing 257. The position of the flanged bushing 257 is determined in accordance with the position of the protruding cylindrical portion 253 so that the insertion holes 261 are contiguous with each other.

The base member 207 is in compliance with, for example, the standards of an Edison screw specified by Japanese Industrial Standards (JIS). The base member 207 is used while being attached to a socket (not illustrated) for a general incandescent light bulb. To be more specific, an E26 base is used as the base member 207 when the LED light bulb 201 is the equivalent of a 60-watt incandescent light bulb, and an E17 base is used as the base member 207 when the LED light bulb 201 is the equivalent of a 40-watt incandescent light bulb.

The base member 207 includes a shell 265, which is also referred to as a cylindrical body portion, and an electrical contact (eyelet) 267 having a shape of a circular dish. The shell 265 and the electrical contact 267 are formed as a single integrated component, with an insulator 269 made of a glass material positioned therebetween.

The outer circumferential surface of the protruding cylindrical portion 253 has an external thread. The base member 207 is attached to the protruding cylindrical portion 253 due to this external thread being screwed and fit into the shell 265.

Once the base member 207 has been attached to the protruding cylindrical portion 253, one end portion of the shell 265 and one end portion of the flanged bushing 257 overlap each other. More specifically, the one end portion of the flanged bushing 257 has a thinner wall thickness than any other portion of the flanged bushing 257. Put another way, the one end portion of the flanged bushing 257 has been recessed. The one end portion of the shell 265 is fit around the one end portion of the flanged bushing 257 having a thin wall thickness. As a result of screwing and fitting the shell 265 around the aforementioned external thread, the one end portion of the shell 265 presses the one end portion (recessed portion) of the flanged bushing 257. This way, the bottom portion 203*c* of the case 203 is securely held between the flange portion 259 and the shoulder portion 260.

Once the shell 265 has been tightly fit around the aforementioned external thread, the one end portion of the shell 265 is crimped into engagement with the flanged bushing 257. The crimping is performed by denting multiple areas in the one end portion of the shell 265 toward the flanged bushing 257 with the use of a crimper or the like.

The first power supply wire 271 that supplies power to the lighting circuit 209 is pulled outside the protruding cylindrical portion 253 via the insertion holes 261. An end of the first power supply wire 271 located outside the protruding cylindrical portion 253 is soldered to and therefore electrically connected to the shell 265.

A through hole 268 is provided in the central portion of the electrical contact 267. A conductor of a second power supply wire 273, which supplies power to the lighting circuit 209, is pulled through the through hole 268 toward the outside of the base member 207 and is connected to the outer surface of the electrical contact 267 by soldering.

When the LED light bulb 201 having the above-described structures is lit while being attached to a socket (not illustrated) of a lighting fixture, the white light emitted from the LED module 205 travels through the globe 231 toward the outside of the LED light bulb 201. The heat generated in the LED module 205 is conducted to the case 203 that functions as a heat dissipation member, via the mount member 211 that functions as a heat conduction member. The heat conducted to the case 203 is dissipated to the atmosphere surrounding the case 203. Consequently, overheating of the LED module 205 can be prevented.

Incidentally, as has been described above, the case 203 is formed in the shape of a cylinder having a thin wall thickness so as to reduce the weight of the LED light bulb 201 as a whole. This is due to the precondition that the LED light bulb 201, which is designed to replace an incandescent light bulb, will be attached to a lighting fixture adapted for the incandescent light bulb that is relatively lightweight.

The thinner the case (housing) is, the more contribution the case makes to weight reduction. However, the thinner the case is, the lower stiffness the case has, and the more susceptible the case is to deformation. Therefore, when the case is made with a thin wall thickness, handleability of the case is reduced during shipping and assembly thereof in the manufacturing process. This poses a detrimental effect on the productivity of the LED light bulb 201.

In view of the above concerns, the inventors of the present application aim to make a case with an appropriate wall thickness that not only contributes to weight reduction, but also causes as less harm as possible to handleability of the case during the manufacturing process.

The following describes a wall thickness of a case and the like based on specific embodiment examples. It should be mentioned that the structural components (e.g., the case) of an LED light bulb that is equivalent to a 40-watt incandescent light bulb have different sizes, etc. from those of an LED light bulb that is equivalent to a 60-watt incandescent light bulb. Therefore, different descriptions will be given below for the former LED light bulb and the latter LED light bulb, respectively.

<LED Module 205>

(a) 40-Watt Equivalent

The substrate 213 has a thickness of 1 (mm). Each side of the substrate 213 has a length of 21 (mm).

There are a total of 48 LEDs (not illustrated) used, which are divided into two groups that each include 24 LEDs. In each group, the 24 LEDs are connected in series with one another. The two groups are connected in parallel with each other.

(b) 60-Watt Equivalent

The substrate 213 has a thickness of 1 (mm). Each side of the substrate 213 has a length of 26 (mm).

There are a total of 96 LEDs (not illustrated) used, which are divided into four groups that each include 24 LEDs. In each group, the 24 LEDs are connected in series with one another. The four groups are connected in parallel with one another.

<Mount Member 211>

(a) 40-Watt Equivalent

The disk portion 225 and the annular portion 223 each have a thickness of 3 (mm). The annular portion 223 has an outer diameter of 37 (mm).

(b) 60-Watt Equivalent

The disk portion 225 and the annular portion 223 each have a thickness of 3 (mm). The annular portion 223 has an outer diameter of 52 (mm).

<Case 203>

Figures 11A, 11B, 11C:
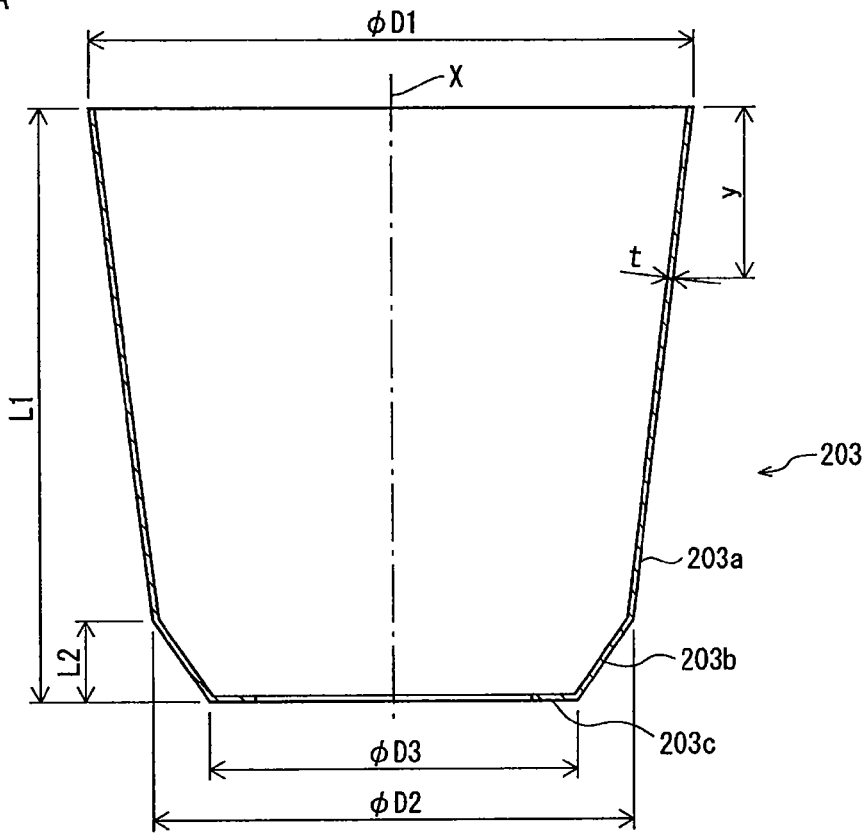
FIGS. 11A, 11B and 11C illustrate the sizes of various portions of the case.

The size of each portion of the case 203 is shown in FIGS. 11A and 11B. Values of the actual sizes of the case 203, which are indicated in FIG. 11A using alphabetical letters, are shown in FIG. 11B. Note that the sizes shown in FIGS. 11A and 11B are of a case where the case 203 is made of aluminum.

The case 203 does not have a uniform wall thickness. Different portions of the case 203 have different wall thicknesses, which are determined in consideration of the following factors. In FIG. 11A, the central axis of the first tapered portion 203*a* (and the second tapered portion 203*b*) is labeled "X", and a distance measured in parallel with the central axis X from a large diameter end of the first tapered portion 203*a*, which is one end of the first tapered portion 203*a* having the largest diameter (an uppermost end of the first tapered portion 203*a* in FIG. 11A), is labeled "y". A wall thickness of a portion of the case 203 that falls within the distance y is labeled "t".

First of all, for the purpose of weight reduction, it is preferable for any portion of the case 203 to have a wall thickness of 500 (μm) or less.

Secondly, a part of the first tapered portion 203*a* that satisfies the relationship y=0 (mm) to 5 (mm) (i.e., a large diameter end part of the first tapered portion 203*a*) needs to have sufficient stiffness to avoid problematic deformation, because this part is most likely to deform due to an external force acting in the diameter direction of the first tapered portion 203*a*. In order to have such stiffness, the large diameter end part of the first tapered portion 203*a* needs to have a wall thickness of 300 (μm) or more.

If the large diameter end part of the first tapered portion 203*a* has a wall thickness of 300 (μm) or more, then the wall thickness of a portion of the case 203 that satisfies the relationship y>5 (mm) may decrease as y increases in order to achieve further weight reduction. However, the wall thickness of the case 203 must not be smaller than 200 (μm) (put another way, the smallest wall thickness of the case 203 needs to be 200 (μm) or more). This is because the LED light bulb 201 is ordinarily attached to a socket of a lighting fixture while the first tapered portion 203*a* is being held by a human hand. Accordingly, it is necessary for the case 203 to have sufficient stiffness to resist such a force applied by the human hand without being deformed.

Due to the difference in taper angles of the first tapered portion 203*a* and the second tapered portion 203*b*, the first tapered portion 203*a* and the second tapered portion 203*b* form an obtuse angle in a border area of the case 203, which is an area of the case 203 around the border between the first tapered portion 203*a* and the second tapered portion 203*b*. Due to the so-called arch effect, the border area of the case 203 has high stiffness to resist an external force acting in the diameter direction of the case 203. Therefore, in terms of stiffness, it is possible to make the border area of the case 203 with a thinner wall thickness than any other area of the case 203. However, in a case where the case 203 is manufactured through deep drawing processing, if the wall thickness of the border area is too thin, the material (an aluminum plate) of the case 203 is ripped during the processing. This results in an extreme decrease in yield.

For this reason, in a case where the wall thickness of the case 203 decreases from the large diameter end of the first tapered portion 203*a* as y increases, it is preferable that a portion of the case 203 having the smallest wall thickness be located (i) in proximity to the border and (ii) between the large diameter end of the first tapered portion 203*a* and the border. In terms of yield, it is preferable for the border area, which includes part of the second tapered portion 203*b*, to have a wall thickness of 250 (μm) or more.

To summarize the above, in order to reduce weight of the LED light bulb 201 and secure stiffness of the case 203, it is preferable for the case 203 to have a wall thickness in a range of 200 (μm) to 500 (μm) inclusive. In order to achieve further weight reduction, it is preferable for the case 203 to include at least one portion that decreases in wall thickness from the large diameter end of the first tapered portion 203*a* toward the bottom portion 203*c*, in an area that is closer to the border area than the large diameter end part (where y=0 (mm) to 5 (mm)) is.

In terms of stiffness, it is preferable for the large diameter end part (where y =0 (mm) to 5 (mm)) to have a wall thickness in a range of 300 (μm) to 500 (μm) inclusive.

FIG. 11C shows wall thicknesses of cases 203 (samples) that were exemplarily made in consideration of the above-described factors. It should be noted that each case (sample) shown in FIG. 11C was designed for an LED light bulb equivalent to a 40-watt incandescent light bulb.

Although not shown in FIG. 11C, a portion of Sample 1 satisfying the relationship y=0 (mm) to 5 (mm) had a wall thicknesses in a range of 0.335 (mm) to 0.350 (mm) inclusive, and a portion of Sample 2 satisfying the relationship y=0 (mm) to 5 (mm) had a wall thicknesses in a range of 0.340 (mm) to 0.350 (mm) inclusive. That is, these portions of Samples 1 and 2 both had a wall thickness of 300 (μm) or more.

A portion of Sample 1 satisfying the relationship y=5 (mm) to 25 (mm), and a portion of Sample 2 satisfying the relationship y=5 (mm) to 20 (mm), gradually decreased in wall thickness as y increased—i.e., from the large diameter end of the first tapered portion 203*a* toward the bottom portion 203*c*.

A part of the first tapered portion 203*a* having the smallest wall thickness (i) was located closer to a small diameter end of the first tapered portion 203*a* (the border between the first tapered portion 203*a* and the second tapered portion 203*b*) than a central area between the large diameter end and the small diameter end of the first tapered portion 203*a* is, and (ii) satisfied the relationship y=20 (mm) to 25 (mm) inclusive. Provided that a reference position of y is 0 and a total length of the case 203 is L1, a ratio of the length of the part of the first tapered portion 203*a* having the smallest thickness to the total length L1 of the case 203 is in a range of 0.52 to 0.65.

Each of Samples 1 and 2 (cases) had a wall thickness in a range of 0.3 (mm) to 0.35 (mm) inclusive as a whole.

<Surface Processing for Case 203>

As has been described above, in the present Second Embodiment, the heat generated in the LED module 205 is conducted to the case 203 via the mount member 211 that functions as a heat conduction member. The heat can be efficiently dissipated with the presence of the case 203 that functions as a heat dissipation member.

Because emphasis is placed on reduction in weight and size of the LED light bulb 201, the following problem occurs. The case 203, which is formed in the shape of a cylinder having a thin wall thickness, has low heat capacity compared to a case formed in the shape of a cylinder having a thick wall thickness. As a result, the temperature of the case 203 can easily be raised. To address this problem, it is necessary to improve the heat dissipation properties of the case 203. One possible way to improve the heat dissipation properties of the case 203 is, for example, to anodize the entire surface of the case 203, which is made of aluminum.

However, simply improving the heat dissipation properties would result in a situation where a large part of the heat conducted to the case 203 is dissipated to the space inside the case 203 in which the lighting circuit 209 is disposed. Consequently, the electronic components of the lighting circuit 209 are overheated.

In view of the above, the inventors of the present application have anodized only the outer circumferential surface of the case so as to (i) improve the heat dissipation properties of the case and (ii) make it as hard as possible for the heat to be trapped inside the case (in the space where the lighting circuit is disposed). More specifically, the case has a double-layer structure composed of an inner layer that is made of aluminum, and an outer layer that is formed on the outer circumferential surface of the inner layer and is made of an anodic film (anodic oxide film).

The inner circumferential surface of the case that is not anodized has an emissivity of 0.05. In contrast, the outer circumferential surface of the case that is, for example, white anodized (coated with a white anodic film) has an emissivity of 0.8. That is, the emissivity of the inner circumferential surface and the emissivity of the outer circumferential surface are different from each other by a decimal order.

Part of the heat conducted to the case is dissipated by radiation. When the outer circumferential surface of the case has higher emissivity than the inner circumferential surface of the case as described above, radiation of heat from the outer circumferential surface of the case is fostered, whereas radiation of heat from the inner circumferential surface of the case is suppressed. This makes it hard for the heat to be trapped inside the case 203. Note that the outer circumferential surface of the case is not limited to being coated with the white anodic film, but may be coated with a black anodic film (with an emissivity of 0.95).

The emissivity of the inner circumferential surface of the case 203 (the first tapered portion 203*a* and the second tapered portion 203*b*) may be lowered to increase the difference between itself and the emissivity of the outer circumferential surface of the case 203. This way, radiation of heat from the outer circumferential surface is further fostered, and radiation of heat from the inner circumferential surface is further suppressed. To be more specific, a silver film (with an emissivity of 0.02) may be formed on the inner circumferential surface of the aluminum base material. Put another way, in this case, the case 203 (the first tapered portion 203*a* and the second tapered portion 203*b*) has a triple-layer structure composed of (i) an intermediate layer made of aluminum, (ii) an outer layer that is formed on the outer circumferential surface of the intermediate layer and made of an anodic film, and (iii) an inner layer that is formed on the inner circumferential surface of the intermediate layer and made of a silver film. The silver film may be applied to the inner circumferential surface of the aluminum base material by silver-plating the inner circumferential surface of the aluminum base material, or vapor-depositing silver on the inner circumferential surface of the aluminum base material.

Furthermore, the outer layer is not limited to being made of the anodic film, but may be made of one or more of the following materials.

(a) Carbon graphite (with an emissivity of 0.7 to 0.9)
(b) Ceramic (with an emissivity of 0.8 to 0.95)
(c) Silicon carbide (with an emissivity of 0.9)
(d) Cloth (with an emissivity of 0.95)
(e) Rubber (with an emissivity of 0.9 to 0.95)
(f) Synthetic resin (with an emissivity of 0.9 to 0.95)
(g) Iron oxide (with an emissivity of 0.5 to 0.9)
(h) Titanium oxide (with an emissivity of 0.6 to 0.8)
(i) Wood (with an emissivity of 0.9 to 0.95)
(j) Black coating (with an emissivity of 1.0)

What matters is that the case 203 should have a layered structure in which multiple layers are disposed on one another in the thickness direction of the case 203, so that in the first tapered portion 203*a* and the second tapered portion 203*b*, the outer circumferential surface of the case 203 has higher emissivity than the inner circumferential surface of the case 203. The layered structure is not limited to the aforementioned double-layer structure and the triple-layer structure, but may be a quadruple-layer structure or a layered structure composed of more than four layers. No matter which one of the above layered structures is employed, the surface of the outer (most) layer should have higher emissivity than the surface of the inner(most) layer.

The outer circumferential surface of the case (the first and second tapered portions) has an emissivity of 0.5 or higher, and the inner circumferential surface of the case has an emissivity lower than 0.5. This is in order to suppress radiation of heat from the LED module to the inside of the case as much as possible, and to improve the effect of dissipation of the heat to the outside of the case. It is desirable that the outer circumferential surface of the case have an emissivity of 0.7 or higher, or more preferably, 0.9 or higher. It is desirable that the inner circumferential surface of the case have an emissivity of 0.3 or lower, or more preferably, 0.1 or lower.

For example, in a case where the case 203 (the first tapered portion 203*a* and the second tapered portion 203*b*) is embedded in the lighting fixture and is therefore invisible from outside after the LED light bulb is attached to the lighting fixture, it is preferable to select the black coating that has the highest emissivity of all the above-listed materials (a) to (j)—i.e., it is preferable to apply the black coating to the outer circumferential surface of the aluminum base material and thereby configure the outer layer as a black coating layer.

<Cylindrical Body 249>

The lighting circuit cover portion 251 of the cylindrical body 249 protects the lighting circuit 209 from unforeseeable deformation of the case 203. However, the existence of the lighting circuit cover portion 251 increases the tendency of heat generated by the lighting circuit 209 to stay around the lighting circuit 209.

In order to cause the heat inside the lighting circuit cover portion 251 to be dissipated to the outside of the lighting circuit cover portion 251 as much as possible by radiation, the black coating is applied to the outer circumferential surface of the lighting circuit cover portion 251 to form a black coating film 275, which functions as an emissivity improvement material. Note that the thickness of the black coating film 275 is emphasized in FIG. 10 to facilitate visualization.

The inner circumferential surface of the lighting circuit cover portion 251 (polybutylene terephthalate), on which the black coating film 275 is not formed, has an emissivity of 0.9. On the other hand, the surface of the black coating film 275 has an emissivity of 1.0.

This way, compared to when the black coating film 275 is not formed at all, the heat inside the lighting circuit cover portion 251 is rapidly dissipated to the outside of the lighting circuit cover portion 251 when the black coating film 275 is formed. This produces the effect of lowering the temperature inside the lighting circuit cover portion 251.

A combination of the material of the lighting circuit cover portion 251 and the emissivity improvement material provided on the outer circumferential surface of the lighting circuit cover portion 251 is not limited to the one described above. For example, when the lighting circuit cover portion 251 is made of aluminum (with an emissivity of 0.05), a nonwoven fabric (with an emissivity of 0.9) may be secured to the outer circumferential surface of the lighting circuit cover portion 251 as the emissivity improvement material.

What matters is that a material having higher emissivity than the inner circumferential surface of the lighting circuit cover portion 251 must be brought in tight contact with and cover the outer circumferential surface of the lighting circuit cover portion 251.

<Modification Examples>

The present invention has been explained above based on the embodiments and the like. However, it goes without saying that the present invention is not limited to the specific examples described in the above embodiments. For example, the following modification examples are possible.

1. Case (Housing)

(1) Shape

In the above embodiments, the case has a cylindrical shape and is made up of the first sloped cylindrical portion, the second sloped cylindrical portion and the bottom portion. Here, the sloped surfaces of the first and second sloped cylindrical portions are substantially straight. However, the case pertaining to the present invention may have openings at both ends whose outer diameters are different from each other, and at least one sloped cylindrical portion (or sloped portion) whose outer diameter decreases from one end of the case having a large diameter toward the other end of the case having a small diameter.

Figure 12A:
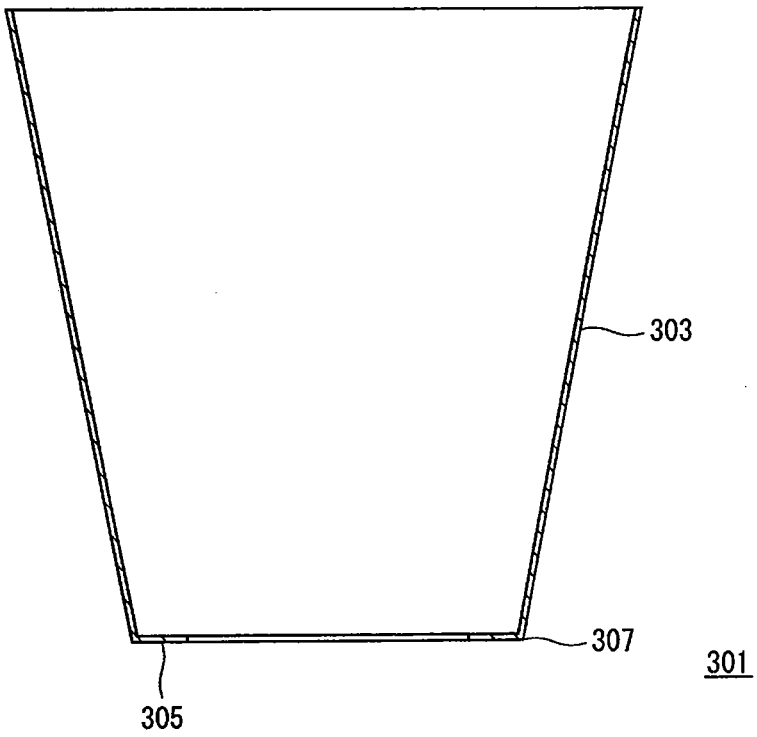
FIGS. 12A and 12B show modification examples 1 and 2 of the case, respectively.
Figure 12B:
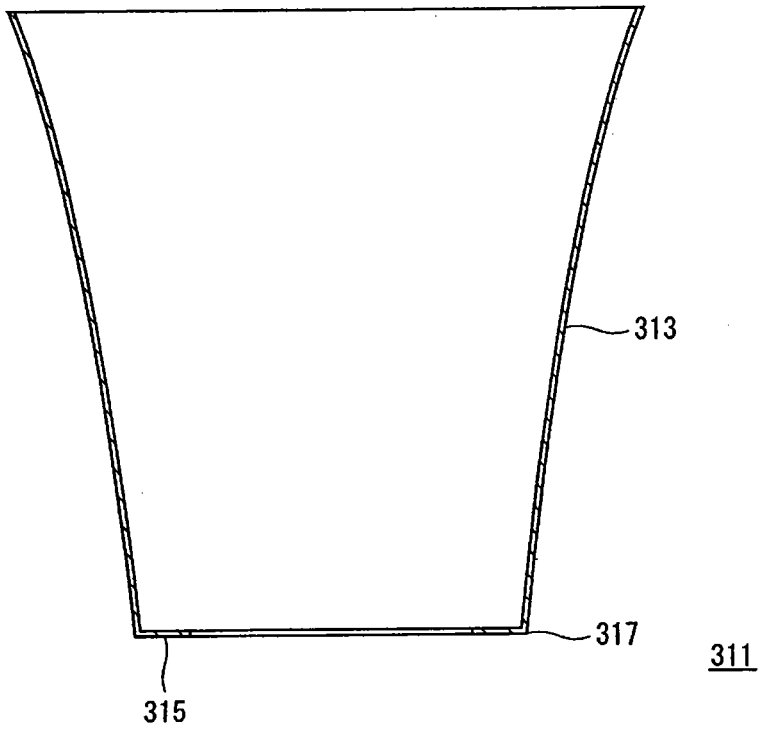

FIGS. 12A and 12B show modification examples of the case. FIG. 12A shows the shape of a case pertaining to modification example 1, and FIG. 12B shows the shape of a case pertaining to modification example 2.

A case 301 pertaining to modification example 1 has a shape of a cylinder having openings with different outer diameters at both ends. As with the above embodiments, the openings of the case 301 having a large outer diameter and a small outer diameter are referred to as a large opening and a small opening, respectively.

The case 301 has a sloped cylindrical portion 303 and a bottom portion 305. The outer diameter of the sloped cylindrical portion 303 decreases from a first end of the sloped cylindrical portion 303 at the large opening toward a second end of the sloped cylindrical portion 303 at the small opening. The bottom portion 305 extends from the second end of the sloped cylindrical portion 303 toward the central axis of the case 301.

The sloped surface of the sloped cylindrical portion 303 is straight (in other words, the sloped cylindrical portion 303 has a uniform angle of slope). The sloped cylindrical portion 303 has an annular shape in a transverse cross section.

The case 301 also has a bent portion 307 between the sloped cylindrical portion 303 and the bottom portion 305. The central area of the sloped cylindrical portion 303 between the first end of the sloped cylindrical portion 303 at the large opening and the bent portion 307 has a thinner wall thickness than a first end portion of the case 301 at the large opening. This central area of the sloped cylindrical portion 303 has sufficient stiffness to resist denting (deformation) caused by the user holding the case 301 by hand. The central area of the sloped cylindrical portion 303 denotes an area between the first end of the sloped cylindrical portion 303 at the large opening and the bent portion 307. When a part of this central area that is in proximity to the bent portion 307 has the thinnest wall thickness, the strength and stiffness of the case 301 are guaranteed more efficiently.

As with modification example 1, a case 311 pertaining to modification example 2 has a shape of a cylinder that has a large opening and a small opening. The case 311 is made up of a sloped cylindrical portion 313 and a bottom portion 315.

The sloped surface of the sloped cylindrical portion 313 is curved (in other words, different parts of the sloped cylindrical portion 303 have different angles of slope). The sloped cylindrical portion 313 has an annular shape in a transverse cross section. The sloped cylindrical portion 313 is curved in such a manner that its outer diameter simply decreases from a first end of the sloped cylindrical portion 313 at the large opening toward a second end of the sloped cylindrical portion 313 at the small opening.

The case 311 also has a bent portion 317 between the sloped cylindrical portion 313 and the bottom portion 315. The central area of the sloped cylindrical portion 313 between the first end of the case 311 at the large opening and the bent portion 317 has a thinner wall thickness than a first end portion of the case 311 at the large opening.

In modification example 2, the sloped cylindrical portion 313 is curved such that it is convex toward the central axis of the case 311. Alternatively, the sloped cylindrical portion 313 may be curved such that it is instead convex toward a direction moving away from the central axis of the case 311 (concave when viewed from the central axis of the case 311).

Figure 13:
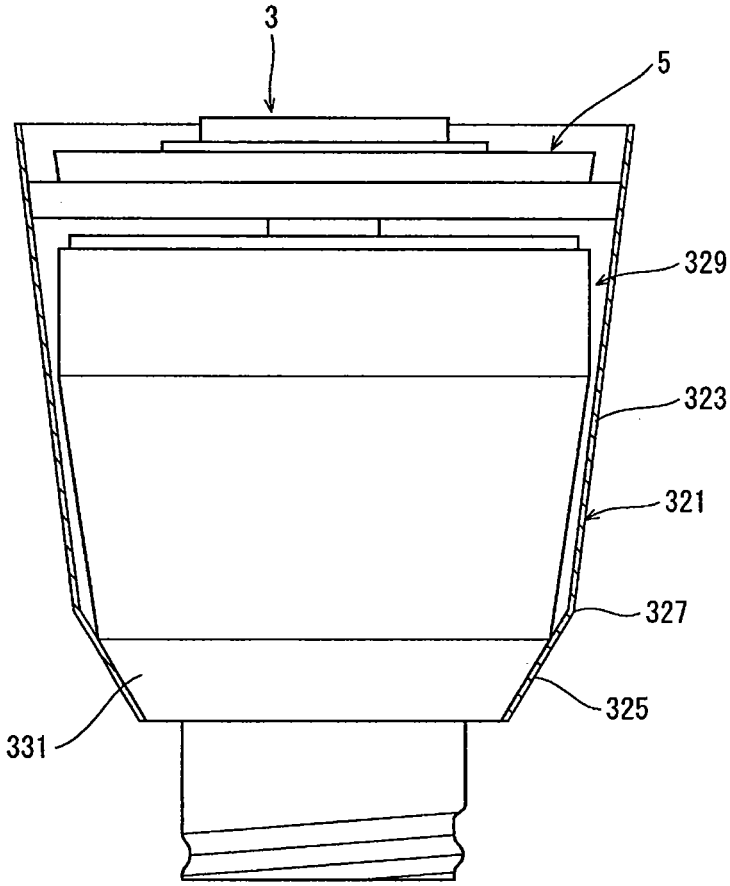
FIG. 13 shows modification example 3 of a case.

FIG. 13 shows modification example 3 of a case.

A case 321 pertaining to modification example 3 has a shape of a cylinder having openings with different outer diameters at both ends. In modification example 3 also, the openings of the case 301 having a large outer diameter and a small outer diameter are referred to as a large opening and a small opening, respectively.

The case 321 includes a first sloped cylindrical portion 323 and a second sloped cylindrical portion 325, both of whose outer diameters decrease from a first end of the case 321 at the large opening toward a second end of the case 321 at the small opening.

The case 321 also includes a bent portion 327 between the first sloped cylindrical portion 323 and the second sloped cylindrical portion 325. The central area of the first sloped cylindrical portion 323 between the first end of the case 321 at the large opening and the bent portion 327 has a thinner wall thickness than a first end portion of the case 321 at the large opening.

As shown in FIG. 13, a circuit holder 329 is configured so that a contact portion 331 thereof comes in contact with the second sloped cylindrical portion 325 of the case 321 during the use of the case 321 pertaining to modification example 3.

In the present modification example 3, the first sloped cylindrical portion 323 and the second sloped cylindrical portion 325 each have a uniform angle of slope. However, their angles of slope may change as explained in the above embodiment example 2. For instance, each of the first sloped cylindrical portion 323 and the second sloped cylindrical portion 325 may be curved so that it is convex toward the central axis of the case 321, or toward a direction that is perpendicular to the central axis of the case 321 and moving away from the central axis of the case 321.

Figure 14:
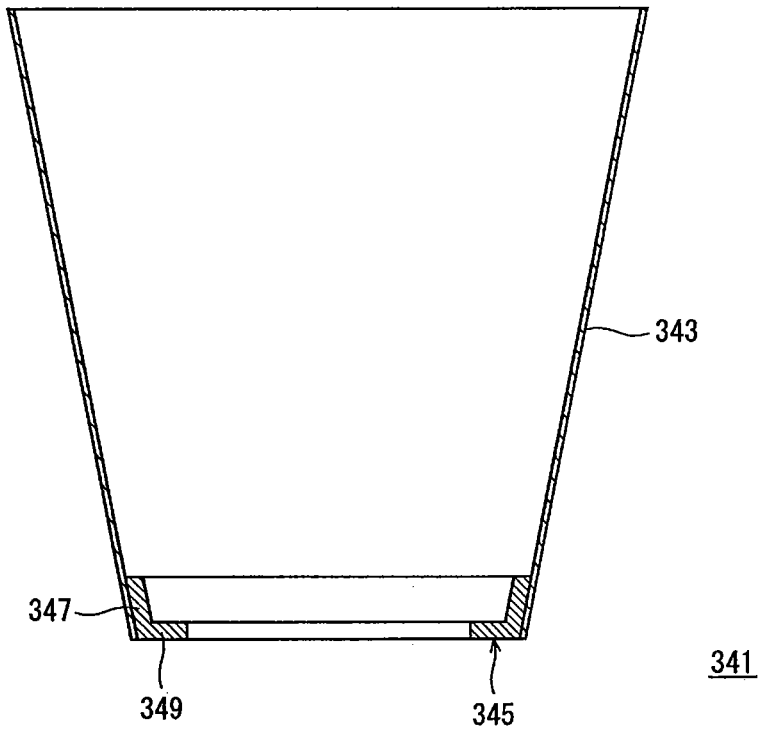
FIG. 14 shows modification example 4 of a case.

FIG. 14 shows modification example 4 of a case.

In the above embodiments and modification examples 1 through 3, the case has at least one bent portion. However, the case may not have any bent portion at all. Below is a description of modification example 4.

A case 341 pertaining to modification example 4 has a shape of a cylinder having openings with different outer diameters at both ends. In modification example 4 also, the openings of the case 341 having a large outer diameter and a small outer diameter are referred to as a large opening and a small opening, respectively.

The case 341 is made up of a sloped cylindrical body 343 and a reinforcement member 345. The outer diameter of the sloped cylindrical body 343 decreases from a first end of the sloped cylindrical body 343 at the large opening toward a second end of the sloped cylindrical body 343 at the small opening. The reinforcement member 345 is attached to the second end of the sloped cylindrical body 343 at the small opening.

The central area of the sloped cylindrical body 343 between the first and second ends of the sloped cylindrical body 343 has a thinner wall thickness than a first end portion of the sloped cylindrical body 343 at the large opening.

By way of example, the reinforcement member 345 has an annular shape. The outer circumferential surface of the reinforcement member 345 is in contact with the inner surface of a second end portion of the sloped cylindrical body 343 at the small opening. The reinforcement member 345 is secured to the sloped cylindrical body 343 by, for example, being pressed into or crimped into engagement with the sloped cylindrical body 343. In this case, an opening of the annular reinforcement member 345 represents the small opening of the case 341.

In the present modification example 4, the reinforcement member 345 has a shape of, for example, a cylinder with a bottom, and is made up of a contact portion 347 and a bottom portion 349. The contact portion 347 has a cylindrical shape and comes in contact with the inner surface of the sloped cylindrical body 343. The bottom portion 349 extends inward from one end of the contact portion 347. The contact portion 347 is sloped in conformity with the slope of the sloped cylindrical body 343 (the contact portion 347 is originally larger than the small opening of the sloped cylindrical body 343). The reinforcement member 345 is inserted into the sloped cylindrical body 343 through the large opening, and secured (fixed) to the sloped cylindrical body 343. This way, the reinforcement member 345 is prevented from falling off the small opening of the sloped cylindrical body 343.

It has been described in the present modification example that the reinforcement member 345 is attached to the second end of the sloped cylindrical body 343 at the small opening. Alternatively, the reinforcement member 345 may be attached to a different portion of the sloped cylindrical body 343. Said different portion of the sloped cylindrical body 343 may have the smallest wall thickness, or may be in proximity to a portion of the sloped cylindrical body 343 having the smallest wall thickness.

Although there is only one reinforcement member in the present modification example, there may be a plurality of reinforcement members. In this case, for example, the plurality of reinforcement members are preferably attached to the second end of the sloped cylindrical body 343 at the small opening, and to a portion of the sloped cylindrical body 343 having the thinnest wall thickness (or in proximity thereto).

Furthermore, by way of example, the reinforcement member may form a part of a member for securing the shell 98 of the base portion 91 (see FIG. 1).

Furthermore, in order to reinforce the sloped cylindrical body 343, the contact portion 331 of the circuit holder 329 may, for example, be brought in contact with the inner circumferential surface of the sloped cylindrical body 343, as shown in FIG. 13.

(2) Material

In the above embodiments, the case 7 is made of aluminum. However, the case 7 may be made of other materials. Said other materials include a metal material such as steel, a ceramic material, a resin material, and the like. Any combination of these materials may be used in accordance with the position and portions of the case 7. However, it should be noted that the case 7 must be made of a material that is resistance to heat generated while the LED module is emitting light.

(3) Anodization

The above embodiments have not provided specific explanations of anodization. It is desirable that the thickness of the anodized layer be in a range of 1 (μm) to 50 (μm) inclusive, or more preferably, in a range of 3 (μm) to 30 (μm) inclusive, or yet more preferably, 5 (μm) to 20 (μm) inclusive.

This is because of the following reasons. When the anodized layer is made thick, the case is resistance to scratches, but there is the need to consider effects on variations in the degree of precision. On the other hand, when the anodized layer is made thin, variations in the degree of precision are reduced, but the case is susceptible to scratches.

Furthermore, the emissivity of the case, which is improved by anodization, can take any number ranging from 0.0 to 1.0 inclusive, because it is calculated under the assumption that a black body has an emissivity of 1. In view of heat dissipation properties, the emissivity of the case is preferably as close as 1.0. If not, the emissivity of the case should be at least 0.5 or higher. It is desirable that the emissivity of the case is 0.7 or higher, or more preferably, 0.9 or higher.

In general, heat is dissipated through heat conduction, convection, and radiation. The heat conduction is mainly represented by conduction of heat to the lighting fixture via the base member 15 (base portion 91). Therefore, if the case 7 has high emissivity (an emissivity of 0.5 or higher), then thermal radiation strongly contributes to heat dissipation.

There are cases where heat dissipation through convection cannot be expected if the lighting fixture, to which the LED light bulb (bulb-type lamp) 1 pertaining to the above embodiments, is hermetically sealed. In order to compensate for heat dissipation through convection, it is necessary to increase the rate of heat dissipation through radiation. Here, the case 7 preferably has an emissivity of 0.7 or higher. If the case 7 has an emissivity of 0.9 or higher, then the case 7 would have substantially the same radiation-oriented heat dissipation properties as a black body.

(4) Surface Processing

The above has described that the emissivity of the case 7 is improved by anodizing the surface of the case 7. The effect of this anodization can also be obtained by making the case from another material having high emissivity, or providing such a material on the surface of the case 7.

Examples of such a material include: carbon graphite that has an emissivity of 0.7 to 0.9 inclusive; a ceramic that has an emissivity of 0.8 to 0.95 inclusive; silicon carbide that has an emissivity of 0.9; a cloth that has an emissivity of 0.95; rubber that has an emissivity of 0.9 to 0.95 inclusive; resin that has an emissivity of 0.9 to 0.95 inclusive; iron oxide that has an emissivity of 0.5 to 0.9 inclusive; and titanium oxide that has an emissivity of 0.6 to 0.8 inclusive.

2. Light Emitting Element

The LEDs 19 used in the LED module 3 pertaining to the above embodiments are so-called LED elements. Alternatively, the LEDs 19 may be of other types.

Figure 15:
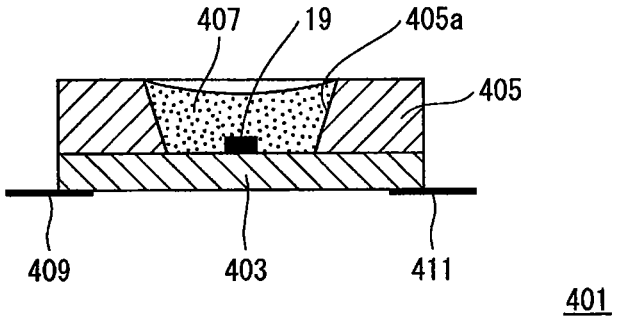
FIG. 15 shows a modification example of a method for mounting an LED element.

FIG. 15 shows a modification example of a light emitting element.

A light source 401 to be mounted on an LED module may be a so-called surface mount device (SMD). In this case, the light source 401 is composed of, for example, a substrate 403, an LED (element) 19, a reflector member 405, and a wavelength conversion member 407. The LED 19 is mounted on a front surface of the substrate 403. The reflector member 405 reflects the light emitted from the LED 19 toward a predetermined direction. The wavelength conversion member 407 seals the LED 19 and converts the wavelength of the light emitted from the LED 19. A terminal 409, which is electrically connected to the LED 19, is attached to a back surface of the substrate 403.

The above structure allows directly attaching terminals 411 and 413, which extend from the back surface of the substrate 403 toward the space external to the substrate 403, to a wiring pattern of a substrate of a mount member (5) by soldering or the like.

As shown in FIG. 15, the reflector member 405 has a through hole 405*a* in a central portion thereof. A surface of the reflector member 405 exposed to the through hole 405*a* is reflective. The diameter of the through hole 405*a* decreases from one main side thereof that is farthest from the LED 19 (the upper side in FIG. 15) toward the other main side thereof that is closest to the LED 19 (the lower side in FIG. 15).

The wavelength conversion member 407 is made by, for example, mixing phosphor particles into a translucent material (e.g., a resin material). The wavelength conversion member 407 is filled in the through hole 405*a* of the reflector member 405.

Other than the LED, an LD may also be used as a light emitting element.

3. Circuit Holder (1) Connection Structure

In the above embodiments, the mount member 5 is movably attached to the case 7 due to the cap 63 being movably attached to the cylindrical body 61 in the circuit holder 13. Alternatively, for example, the mount member may be movably attached to the case by utilizing other components.

One example of utilizing other components is to attach the mount member to the circuit holder so that the circuit holder is movable in the central axis direction of the case. This can be achieved by, for example, extending the length of the connector member 75 (i.e., the screw having the external thread) shown in FIG. 1. In this structure, however, the mount member and the circuit holder do not come in contact with each other if the mount member is not inserted deep enough into the case.

(2) Relationship between Circuit Holder and Case

In the above embodiments, the contact portion 59 of the circuit holder 13 is in contact with the inner surface of the bottom wall 47 of the case 7. Alternatively, other portion of the circuit holder 13 may be in contact with the case 7.

Figure 16:
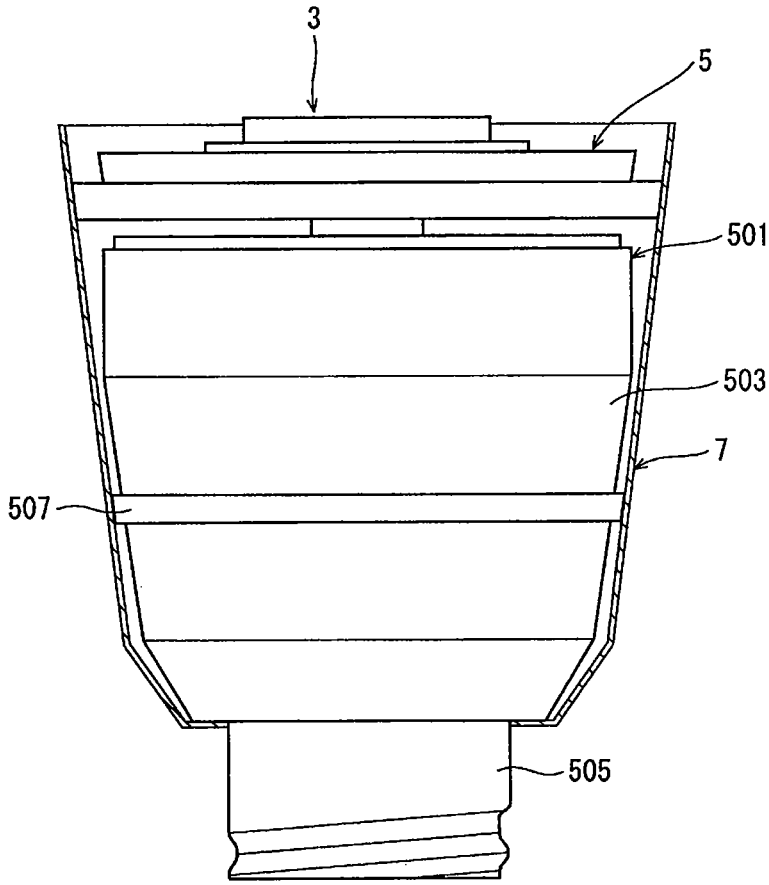
FIG. 16 shows a modification example of a holder.

FIG. 16 shows a modification example of a holder.

In a circuit holder 501 pertaining to the present modification example, a part of a side wall of a holder body 503 is in contact with a part of the cylindrical wall of the case 7, to the extent that this contact between the circuit holder 501 and the case 7 does not affect heat conduction. This structure works as a deformation prevention mechanism for preventing deformation of the case 7.

As with the above embodiments, the circuit holder 501 includes the holder body 503 and a protruding cylindrical portion 505. In the present modification example, the circuit holder 501 additionally includes a projection 507 on the outer circumferential surface of the holder body 503. The projection 507 lies on the outer circumferential surface of the holder body 503 in a circle like a belt. An outer circumferential surface of the projection 507 is in contact with or adjacent to a part of the inner surface of the case 7 (here, "adjacent to" means that the outer circumferential surface of the projection 507 is in such proximity to the part of the inner surface of the case 7 that, if the case is dented as a result of being subjected to a load, the deformation cannot be visually recognized).

The projection 507 is preferably positioned on or in proximity to a portion of the cylindrical wall 45 of the case 7 that has the thinnest wall thickness.

In the present modification example, the belt-like projection 507 is provided in a single tier. Alternatively, a plurality of projections 507 may be provided in multiple tiers to the extent that they do not affect conduction of heat to the circuit holder 501. Also, in the present modification example, the projection 507 lies in a circle like a belt. Alternatively, a plurality of projections 507 may lie at equally spaced intervals along the circumferential direction of the circuit holder 501, or may lie zigzag at equally spaced intervals along the circumferential direction.

4. Mount Member

In the above embodiments, the mount member 5 has a shape of a disk with a predetermined thickness, and has the recess 29 for the purpose of weight reduction and the like. Alternatively, the mount member 5 may be manufactured from a plate-like material.

Figure 17:
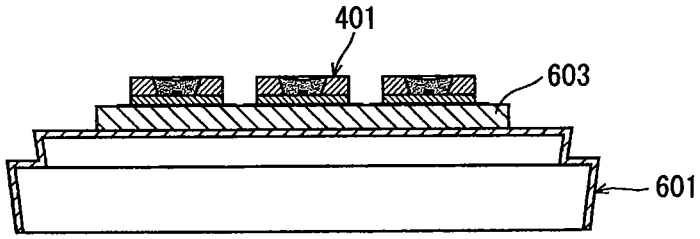
FIG. 17 shows a modification example of a mount member.

FIG. 17 shows a modification example of a mount member.

A mount member 601 is made of a plate-like material. To be more specific, a part of the mount member 601 that comes in contact with the case can be formed through bending processing. In a case where the plate-like material for the mount member 601 is made of, for example, aluminum, the plate-like material should have a thickness in a range of 200 (μm) to 500 (μm) inclusive. Alternatively, the plate-like material may be made of other metals.

With the above structure, the workability of the mount member 601 is ensured. This way, the contact area S1 can be further increased even if the mount member 601 is made thin as a whole. Also, making the mount member 601 thin contributes to weight reduction. Furthermore, with the presence of such a thin mount member 601, it is easy to secure a circuit holder space in which the lighting circuit 11 is to be disposed, which further contributes to size/weight reduction.

In the present example, surface mount components 401 are used as a light source and mounted on the mount member 601 via a substrate 603.

5. Conclusion

The following describes one example of a lighting device comprising one of the above-described LED light bulbs (for example, the LED light bulb 1 pertaining to First Embodiment) as a light source.

Figure 18:
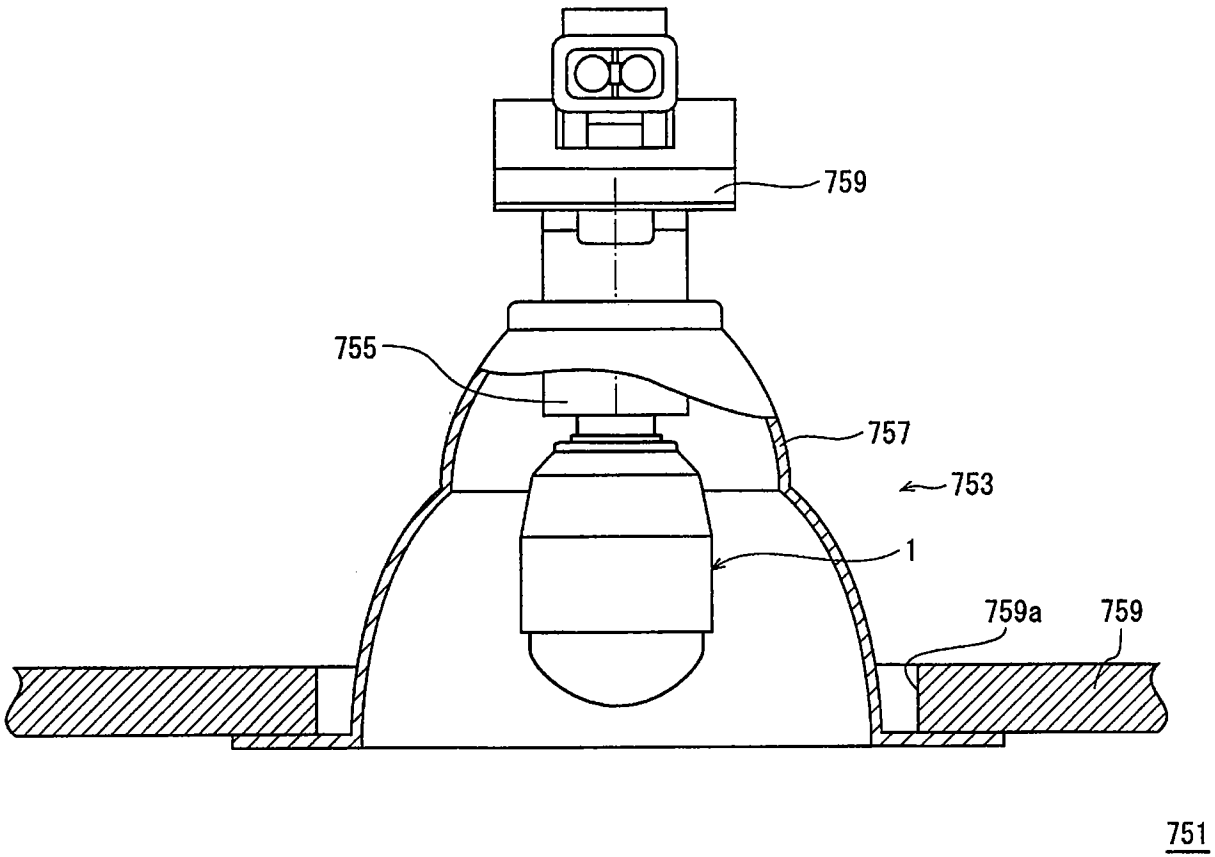
FIG. 18 illustrates a lighting device pertaining to one embodiment of the present invention.

FIG. 18 illustrates one example of a lighting device pertaining to one embodiment of the present invention.

A lighting device 751 includes the LED light bulb 1 and a lighting fixture 753. This lighting fixture 753 is a so-called downlight fixture.

The lighting fixture 753 is composed of a socket 755, a reflective plate 757, and a connector 759. The socket 755 is electrically connected to the LED light bulb 1 and holds the LED light bulb 1. The reflective plate 757 reflects the light emitted from the LED light bulb 1 toward a predetermined direction. The connector 759 is connected to a commercial power source, which is not illustrated.

Here, the reflective plate 757 is attached to a ceiling 759 so as to allow inserting the socket 755 into the ceiling 759 via an opening 759*a* of the ceiling 759, with the socket 755 positioned deep in the ceiling 759.

It goes without saying that a lighting device pertaining to the present invention is not limited to the above-described lighting device for a downlight.

In conclusion, although the above embodiments and modification examples have separately explained the features of the present invention, the structures explained in the above embodiments and modification examples may be combined with one another.

In conclusion, although the above embodiments and modification examples have separately explained the features of the present invention, the structures explained in the above embodiments and modification examples may be combined with one another.

INDUSTRIAL APPLICABILITY

The present invention can be used to reduce the weight of a housing and to prevent deformation of the housing when attaching the housing to a lighting device. Thus, the present invention is useful in improving handleability of the housing during assembly of the lighting device.

REFERENCE SIGNS LIST

1 LED light bulb (bulb-type lamp)
3 LED module (light emitting module)
5 mount member
7 case (housing)
9 globe
11 lighting circuit
13 circuit holder
15 base member
17 substrate
19 LED (light emitting element)
91 base portion (base)

The invention claimed is:

1. A lamp comprising:
a light emitting module on which at least one light emitting element is mounted;
a cylindrically-shaped metallic housing having openings at both ends, which are first and second ends;
a mount member on a front surface of Which the light emitting module is mounted, the mount member closing a corresponding one of the openings of the housing by being in contact with an inner circumferential surface of the first end of the housing; and
a base attached to the second end of the housing, wherein
the second end of the housing has smaller outer and inner diameters than the first end of the housing, and a wall thickness of at least one portion of the housing decreases from the first end toward the second end of the housing.

2. The lamp of claim 1, wherein
a wall thickness of the housing is in a range of 200 μm to 500 μm inclusive.

3. The lamp of claim 2, wherein
the housing is manufactured through drawing processing.

4. The lamp of claim 1, wherein
the housing is manufactured through drawing processing.

5. The lamp of claim 1, wherein
the housing allows dissipation of heat generated by the at least one light emitting element emitting light,
the housing includes a bent portion, and
a portion of the housing that lies between the bent portion and the second end of the housing extends toward a central axis of the housing.

6. The lamp of claim 5, wherein
the at least one portion of the housing is located between the first end and the bent portion of the housing.

7. The lamp of claim 5, wherein
the housing has a smallest wall thickness between (i) a central area between the first end and the bent portion of the housing and (ii) the bent portion of the housing.

8. The lamp of claim 1, wherein
an outer circumferential surface of the mount member and the inner circumferential surface of the first end of the housing are sloped at the same angle of slope with respect to a central axis of the housing.

* * * * *